US011160401B2

(12) United States Patent
Naumann

(10) Patent No.: US 11,160,401 B2
(45) Date of Patent: Nov. 2, 2021

(54) FULL VOLUME ANGLED DISPENSING

(71) Applicant: Curtis William Naumann, Baltimore, MD (US)

(72) Inventor: Curtis William Naumann, Baltimore, MD (US)

( * ) Notice: Subject to any disclaimer, the term of this patent is extended or adjusted under 35 U.S.C. 154(b) by 378 days.

(21) Appl. No.: 16/512,179

(22) Filed: Jul. 15, 2019

(65) Prior Publication Data

US 2021/0015279 A1 Jan. 21, 2021

(51) Int. Cl.
*A47G 19/22* (2006.01)

(52) U.S. Cl.
CPC ..... *A47G 19/2266* (2013.01)

(58) Field of Classification Search
CPC ..... A47G 19/02; A47G 19/14; A47G 19/145; A47G 19/16; A47G 19/22; A47G 19/2205; A47G 19/2266; A47G 19/2272; A47G 2019/122
USPC ..... 215/17, 18, 19, 20, 21, 22, 23, 24, 25, 215/26, 27, 28, 29, 30; 220/501, 503, 220/529, 555, 703, 719; 222/454
See application file for complete search history.

(56) References Cited

U.S. PATENT DOCUMENTS 2,170,311 A * 8/1939 Smith ..... A47G 19/02 220/575
2,705,334 A * 4/1955 Farrow ..... B44D 3/126 15/257.06
4,277,000 A * 7/1981 Jaarsma ..... B65D 25/04 215/6
4,301,942 A * 11/1981 Kupperman ..... A47G 19/2288 215/13.1
4,921,112 A * 5/1990 Juhlin ..... A47G 19/2272 215/11.4
5,449,097 A * 9/1995 Meyer ..... G01F 11/265 222/450
5,588,561 A * 12/1996 Ness ..... A47G 19/02 206/217
5,727,708 A * 3/1998 Erickson ..... B44D 3/12 206/514
6,065,633 A * 5/2000 Abbey ..... B44D 3/121 220/501
6,502,712 B1 * 1/2003 Weber-Unger .... A47G 19/2205 220/23.83
7,784,145 B1 * 8/2010 Prokop ..... B44D 3/126 15/257.06
9,756,969 B2 * 9/2017 Civelli ..... A47G 19/2205
11,071,692 B1 * 7/2021 Le ..... A61J 11/0015
(Continued)

FOREIGN PATENT DOCUMENTS

WO WO-2020186215 A1 * 9/2020 ..... A47G 19/2205

*Primary Examiner* — Joshua E Rodden

(57) ABSTRACT

The travel mug includes a vessel with a removable, angled partition and an engageable flow restrictor. The partition separates the vessel into a fluid reservoir chamber and a fluid dispensing chamber. The fluid dispensing chamber has a direct fluid flow path out of the upper, open end of the vessel. The fluid reservoir chamber has an indirect flow path out of the upper, open end of the vessel through the fluid dispensing chamber. An engageable flow restrictor is configured to control fluid flow along the indirect fluid flow path at the partition. The flow restrictor is disengaged when the travel mug is upright and at rest and engaged when the travel mug is positioned for dispensing.

20 Claims, 14 Drawing Sheets

(56) References Cited

U.S. PATENT DOCUMENTS

| | | | | |
|---|---|---|---|---|
| 2008/0264960 | A1* | 10/2008 | Phillips | A47G 19/2266<br>220/719 |
| 2009/0188929 | A1* | 7/2009 | Sims | A47G 19/2205<br>220/710 |
| 2010/0287723 | A1* | 11/2010 | Prokop | B44D 3/126<br>15/257.06 |
| 2011/0259206 | A1* | 10/2011 | Brennan | A47G 19/14<br>99/304 |
| 2012/0261410 | A1* | 10/2012 | DuHaime | B65D 21/0206<br>220/23.83 |
| 2014/0312075 | A1* | 10/2014 | Antal, Sr. | G01F 11/06<br>222/464.1 |
| 2016/0046407 | A1* | 2/2016 | Robert | A47G 19/00<br>426/2 |

* cited by examiner

FULL VOLUME ANGLED DISPENSING

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURE BY THE INVENTOR OR A JOINT-INVENTOR

Not Applicable

FIELD OF THE INVENTION

This invention relates to dispensing containers and more particularly to mugs in the popular form known as "travel mugs."

BACKGROUND OF THE INVENTION

While travel mugs are only a recent addition in the history of beverage containers, their overwhelming acceptance is evidenced in cup holders being included as basic features in essentially all vehicles. Designed with the challenges of driving in mind, (e.g., bumpy roads, short stops, sharp turns and the like) travel mug companies and automobile manufacturers are constantly adding features to their products to improve passenger safety and reduce driver distracted accidents that can result from eating and drinking while driving. Most travel mugs include sealed lids to reduce spills, single hand operation to keep one hand on the wheel, and standardized cup holders to keep mugs securely in place while en route.

While vehicle standards and modifications have gone a long way to reduce distracted driving accidents, an area within distracted driving that receives little or no attention, and yet, continues to contribute to automobile related accidents is "obstructed view" driving. As drivers consume more and more of their beverage from their travel mugs, steeper and steeper tilting of the mug is required to continue dispensing. At some point, the mug tilt becomes sufficiently steep as to obstruct the field of vision, potentially contributing to an accident. Thus, there is a need for a travel mug that reduces the obstructed field of vision during use without the need to decrease the travel mug's available volume or modify its dimensions.

SUMMARY OF THE INVENTION

It is the principal object of the invention to provide a new and improved travel mug. More particularly, it is an object of the invention to provide a new and improved travel mug that reduces the required tilt for dispensing and makes available the travel mug's entire volume.

According to one facet of the claimed invention, a travel mug comprises a vessel configured to hold a fluid within an interior chamber, comprising an open upper end, configured to allow dispensing of the fluid out of the vessel, and a lower end, wherein the lower end is configured to rest on a horizontal surface where horizontal is defined by any plane perpendicular to the line defined by the center of gravity of the vessel plus any contents and earth center; and wherein the vessel further comprises a vertical height that is perpendicular to horizontal.

A partition, disposable within the interior chamber of the vessel, at an angle with respect to the vertical height of the interior chamber, is configured to separate the chamber into at least a fluid dispensing chamber and a fluid reservoir chamber, wherein the fluid dispensing chamber has a direct fluid flow path out of the vessel and the fluid reservoir chamber has an indirect fluid flow path out of the vessel through the fluid dispensing chamber.

The invention further includes a mechanism for blocking the indirect fluid flow path. (Note: Subsequent use of fluid blocking mechanism is to be understood to mean the mechanism for blocking the indirect fluid path.) Together the indirect fluid path and fluid blocking mechanism form a flow restrictor. The flow restrictor is the means by which full volume utilization of the travel mug becomes possible when employing angled dispensing. Both the vessel and partition are constructed of relatively hard material, typically metal or plastic.

A simple, indirect fluid flow path is a vertically centered, circular hole passing through the partition near the partition bottom.

A fluid blocking mechanism complementary to the circular hole is a ball bearing, typically rubberized steel, with circumference slightly larger than the hole, constrained within a slightly downward angled cage, constructed of relatively hard material, typically metal or plastic, centered on the hole and attached to the partition, with open sides to allow fluid flow and permit the ball bearing to move within the cage but not escape it. Positioning the travel mug for dispensing so fluid flows along the partition, the ball bearing rolls forward under gravity, drops slightly into the hole, and blocks fluid transfer. Once blocked, the flow restrictor is said to be engaged. During dispensing, fluid held within the fluid reservoir chamber is forced to travel down the partition and out through the open upper end of the vessel. Returning the travel mug to an upright position, the ball bearing drops out of the hole under gravity allowing fluid to flow between the chambers until the vertical fluid levels equalize (chamber equalization). Once unblocked, the flow restrictor is said to be disengaged.

In other embodiments of the invention, the flow restrictor could include: 1) a hinged window mounted near the bottom of the partition that is closed when the travel mug is positioned for dispensing and open otherwise and 2) a slidable partition with guides integrally connected the interior of the vessel that blocks fluid flow between the chambers when slid downward against the vessel bottom and allows fluid flow between the chambers when slid upward off the vessel bottom.

Additionally, the invention includes an air flow path that allows air to exit the fluid reservoir chamber thereby reducing pressure within the the fluid reservoir chamber so that fluid can flow into the fluid reservoir chamber during filling. Furthermore, the air flow path allows air to enter the fluid reservoir chamber thus preventing a vacuum from forming so that fluid can flow out of the fluid reservoir chamber during chamber equalization. A simple embodiment of the air flow path is fashioned as a circular hole, vertically centered that passes through the partition near the partition top. The circular hole reduces the amount of fluid for dispensing as a small amount of fluid transfers into the fluid reservoir chamber; however, covering the hole with a specialized laminate that allows air flow but prevents fluid transfer corrects this problem.

In a highly preferred embodiment of the invention, the partition is constructed to be removable from the vessel so that unused contents are easily discarded from the vessel and for cleaning. As a result of the foregoing, a potential leakage path between the partition and the interior surface of the vessel exists. A simple method for sealing the potential leakage path is to add a friction fit edge to the partition that prevents leakage between the chambers when the partition is fully disposed into the vessel.

According to another facet of the invention, a lid is removably disposed inside and within a vessel shoulder mounted to the top of the vessel. Both the lid and vessel shoulder are constructed of relatively hard material, typically metal or plastic. The lid includes an interior wall with an inner step and a central recess with downward sloping top surface directed toward a dispensing port. The dispensing port directs and controls the flow and rate of liquid exiting the container and the sloping surface directs fluid back into the container through the dispensing port when sloshing into the recess occurs as a result of movement.

A potential leakage path between the external surface of the stepped connecting wall of the lid and the interior surface of the vessel shoulder is sealed by adding friction fit surfaces to both the external surface of the stepped connecting wall of the lid and the interior surface of the vessel shoulder.

In one embodiment of the invention, a partition-lid alignment mechanism ensures optimal functionality when dispensing fluid. A post, with vertical height equal to the height of the vessel shoulder and horizontal cross section slightly smaller than that of the dispensing port, is attached to the top surface of the partition such that when aligned and coupled with the lid at the dispensing port, the post enters into the dispensing port allowing the lid to seal securely to the vessel shoulder. Unless the post and the dispensing port are aligned so that the dispensing port is able to receive the post when the lid is disposed, the lid will not fit securely onto the vessel shoulder.

By having the dispensing port aligned to the partition in this manner, fluid flows along the partition during dispensing and is received by the lid's dispensing port. In doing so, ensures that the capabilities of angled dispensing are maximized.

In a highly preferred embodiment of the invention, a first lid valve is constructed within the dispensing port to restrict fluid flow through the dispensing port if the partition is not inserted into the travel mug prior to disposing the lid. The first lid valve safeguards against use of the travel mug without the partition being disposed.

In an additional, highly preferred embodiment of the invention, a second lid valve is constructed within the dispensing port and located above the first lid valve. The second lid valve acts to throttle or completely block fluid flow through the dispensing port once the travel mug is tipped beyond a configured threshold angle. The second lid valve "encourages" use of the travel mug with angled dispensing as designed; otherwise, dispensing is slowed or halted should the user position the travel mug too steeply.

BRIEF DESCRIPTION OF THE DRAWINGS

FIG. 1*c'* shows, in simplified form, a vertical cross section of the travel mug taken approximately along the line AA-AA in FIG. 1*b* and tipped at an angle β°;

FIG. 2*b'* shows, in simplified form, a detailed vertical cross-section view of the engaged flow restrictor as taken from CC in FIG. 1*c'* with the travel mug tipped at an angle β° relative to horizontal;

FIG. 3*a'* shows, in simplified form, a vertical cross-section view of the travel mug partially filled with fluid, positioned for dispensing at an angle of 90° from horizontal, flow restrictor engaged;

FIG. 6*c'* shows, in simplified form, a detailed cross-section view of the engaged steep tip flow throttle taken along the line GG-GG in FIG. 6*b* tipped at 90°+α° and blocked from dispensing fluid;

DETAILED DESCRIPTION OF THE INVENTION

Figure 1A:
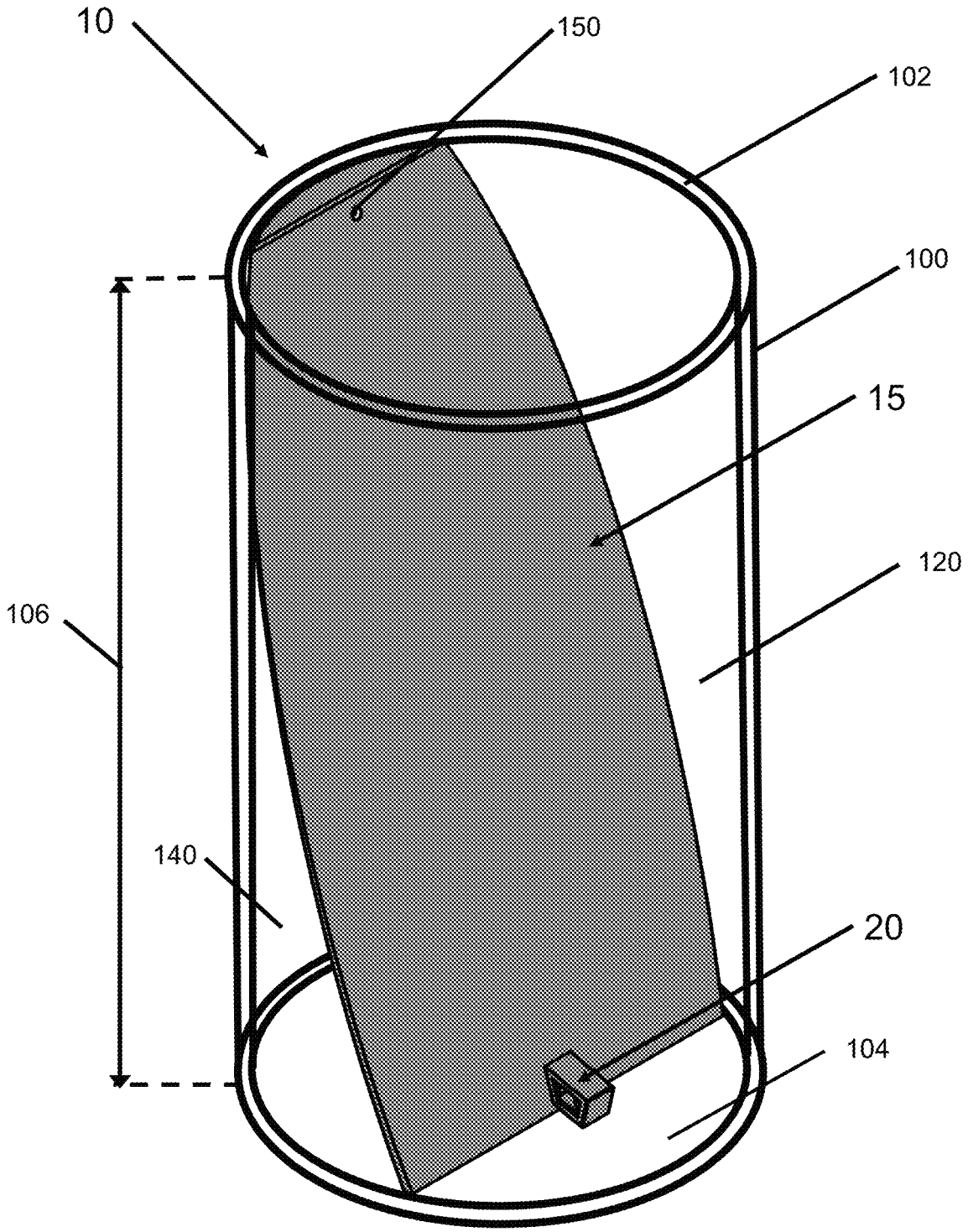
FIG. 1*a* shows, in simplified form, a perspective view of a travel mug made according to the invention.

Various embodiments of "full volume" angled dispensing utilizing an angled partition with flow restrictor will be presented. The simplest embodiment will be discussed first with subsequent embodiments building upon those previously discussed.

An exemplary embodiment of the invention is illustrated in the drawings in the form of a travel mug. However, it is to be understood that the principles of the invention will find utility in other applications involving containers provided with lids where angled dispensing is required. Accordingly, it is to be recognized that the invention is not to be limited to a travel mug except insofar as so restricted in the appended claims.

We begin the discussion of the various embodiments with an embodiment of the invention that uses a sealed partition, as this is the easiest to understand. This first embodiment introduces a simple method for constructing angled dispensing that benefits from access to the full/entire volume of the vessel, while subsequent embodiments will, among other things, introduce a mechanism to help ensure optimal operation and mechanisms to safeguard users. FIG. 1*a* shows, in simplified form, a perspective view of a travel mug 10 made according to the invention. Referring to FIG. 1*a*, the travel mug 10, upright and at rest, is seen to include a vessel 100 configured to hold a fluid and having an interior chamber, an open upper end 102, and a lower end 104 with a planar surface parallel to that of the open upper end 102. The lower end 104 is configured to be at rest when placed on a horizontal surface or positioned so that the lower end 104 is parallel to the horizontal surface. Horizontal is defined by any plane perpendicular to the line defined by the center of gravity of the vessel 100 plus any contents and earth center. With this definition of horizontal, the travel mug 10 can be at rest, for example, when sitting on a flat, non-tilting table (horizontal) but can also be at rest when being held upright as long as the lower end is horizontal. The vessel 100 further comprises a vertical height 106 that is perpendicular to horizontal.

A partition 15, disposed in the vessel 100, is represented as joined and sealed to the inside wall of the vessel 100 thereby separating the interior chamber into two distinct chambers: 1) a fluid dispensing chamber 120 and 2) a fluid reservoir chamber 140. The fluid dispensing chamber 120 has a direct fluid flow path out of the open upper end 102 of the vessel 100 and the fluid reservoir chamber 140 has an indirect fluid flow path out of the open upper end 102 of the vessel 100, through the fluid dispensing chamber 120 (through a blockable fluid flow path). As a result, all fluid enters and exits the vessel 100 through the fluid dispensing chamber 120.

A flow restrictor 20, is configured to create a blockable fluid flow path between the fluid dispensing chamber 120 and the fluid reservoir chamber 140. The flow restrictor 20, comprising an indirect fluid flow path and a blocking mechanism, is configured to block fluids from passing through the partition 15 when engaged and allow fluid to pass through the partition 15 when disengaged.

Depending on the construction materials used for the partition 15 and vessel 100, typically a hardened plastic or metal, representative techniques for sealing the partition 15 to the inside wall of the vessel 100 include but are not limited to the following: 1) forming the two components as a single component through molding or 2) connecting the components with solvents, glue, or welding. The importance not being the specific technique for sealing the partition 15 to the inside wall of the vessel 100 but that it form a watertight barrier between the fluid dispensing chamber 120 and the fluid reservoir chamber 140.

As a result of the watertight barrier, fluid flow is represented as being restricted between the two chambers 120, 140, except through two locations: 1) the flow restrictor 20 (configured to control the flow of fluids between the two chambers 120, 140) and 2) an aperture 150 (configured to control the flow of air into and out of the fluid reservoir chamber 140).

The function of the flow restrictor 20 is to allow fluid to pass between the two chambers 120, 140 under certain conditions and to block flow between the two chambers 120, 140 under other conditions. As previously mentioned, fluid is blocked from passing through the partition 15 when the flow restrictor 20 is engaged and fluid is free to pass through the partition 15 at the flow restrictor 20 when the flow restrictor 20 is disengaged.

The aperture 150 performs a critical function which is to act as an air exchange mechanism allowing the flow of air into and out of the fluid reservoir chamber 140. Without the aperture 150 (an air flow path/air exchange mechanism), the volume of trapped air inside the fluid reservoir chamber 140 would prevent fluid flow through the disengaged flow restrictor 20 and into the fluid reservoir chamber 140. Conversely, once fluid is in the fluid reservoir chamber 140, without the aperture 150, a vacuum is formed, as there is no means to replace any lost volume of fluid. Fluid is trapped within the fluid reservoir chamber 140 and cannot flow through the disengaged flow restrictor 20 and into the fluid dispensing chamber 120.

The aperture 150 is represented as a hole that passes through the partition 15 near the partition 15 top and is sized sufficiently small such that the fluid flow into the fluid reservoir chamber 140 from the fluid dispensing chamber 120 during dispensing is minimized. In practice, the flow of fluid from the fluid dispensing chamber 120 into the fluid reservoir chamber 140 through the aperture 150 during dispensing should not exceed 50% of the fluid flow out of the vessel 100 through the fluid dispensing chamber 120, with 90% or less being highly desirable.

As a result of the potential fluid flow into the fluid reservoir chamber during dispensing, it will be readily appreciated that the aforementioned aperture reduces the available fluid for dispensing, however small. It will also be appreciated that other shapes of, positions of, and/or advantageous techniques could be used to construct the aperture to eliminate any reduction in available fluid for dispensing that include but are not limited to: 1) covering the hole with a specialized material that allows for airflow across the material but not fluid flow through it as taught in the U.S. Pat. No. 4,194,041A or 2) augmenting the aperture with a second flow restrictor at the location of the aperture whereby the aperture becomes the indirect fluid path. With the second flow restrictor in place, liquid and air are free to flow between the two chambers at the second flow restrictor when the travel mug is upright and at rest. When the travel mug is positioned for dispensing, liquid and air are restricted from flowing between the two chambers at the second flow restrictor.

Such variations of the aperture are intended to be within the scope of the invention as broadly described and claimed herein. The importance being not the particular configuration of the aperture but that air is able to enter and exit the fluid reservoir chamber to facilitate fluid flow through the flow restrictor. (Note: Given the techniques just mentioned, it becomes clear that the air flow path need not necessarily be between the fluid reservoir chamber and the fluid dispensing chamber. It could, in a similar fashion, be between the fluid reservoir chamber and ambient air.) The importance being that air flow is allowed to occur out of and into the fluid reservoir chamber in order to allow fluid to flow between the fluid dispensing and fluid reservoir chambers.

While additional details will be provided shortly, we return to FIG. 1*a* to provide a general description of the function of the flow restrictor 20. With the travel mug 10 upright and at rest, the flow restrictor 20 is configured to be disengaged and fluid flow is unrestricted across the chambers 120, 140. As the travel mug 10 is positioned for dispensing in a manner so that fluid flows along the partition, the flow restrictor 20 engages and blocks fluid from transferring to the fluid reservoir chamber 140 through the flow restrictor 20. As was previously discussed, a small amount of fluid, otherwise meant for dispensing, will be transferred into the fluid reservoir chamber 140 via the aperture 150, but that amount is small in comparison to the fluid volume exiting the travel mug 10 during dispensing.

We will now turn our attention to describe the partition 15 geometry in greater detail. FIG. 1*c* shows, in simplified form, a vertical cross-section view of the travel mug 10 taken along line AA-AA in FIG. 1*b*.

FIG. 1*c* shows the travel mug 10, upright and at rest, with a tipping angle 0° 159 with respect to horizontal. (Note: Subsequent references to the travel mug 10 being upright and at rest will be taken to mean that the travel mug 10 has a tipping angle 0° 159 from horizontal.)

The angled divider component 154 bisects the vessel 100 at an angle θ° 156 from vertical and is sealed to the vessel 100 at the bisection points. (Note: The bisection is represented as nonsymmetrical with respect to the interior chamber of the vessel 10 but could just as easily have been symmetrically distributed. Additionally, the angled divider component 154 is represented as spanning the entire height of the vessel 100, as this has been observed to provide the least turbulent flow when dispensing. However, shortened angled divider components that do not span the entire height of the vessel 100 are also anticipated.)

Continuing our attention on FIG. 1*c*, the top of the angled divider component 154 is shown together with a cap 152. The cap 152 may or may not exist depending on the nature of the bisection of the angled divider component 154 in relation to the vessel 100 wall. For example, if angled divider component 154 were shifted slightly left or the bisecting angle θ° 156 were increased and the angled divider component 154 lengthened slightly then it is easy to understand how the cap 152 would become unnecessary (e.g., the top of the angled divider component 154 and the top of the vessel 100 form a point of tangency). Together, the cap 152 and the angled divider component 154 form the partition 15.

We will be presenting the capped version of the partition 15 because it is useful for the subsequent presentation of optimization and safety features. (Note: The cap 152 could be a separate component, part of the partition 15, part of the vessel 100, or, as previously stated, eliminated altogether.) The edges of the partition 15 are sealed to the interior of the vessel 100. The volume below the partition 15 forms an isolated chamber, the fluid reservoir chamber 140.

The vessel 10 volume complementary to the fluid reservoir chamber 140 forms the fluid dispensing chamber 120 and an open area 102 bound by the top surface of the open vessel 100 and the cap 152 is the conduit by which fluid enters and exits the travel mug 10.

Rotating the travel mug 10 (counterclockwise as represented in the drawing) about a line 157, formed by bisecting the planar surface of the angled divider component 154 with a second, horizontal plane, in a direction that causes the planar surface of the angled divider component 154 to initially become increasingly parallel to the horizontal surface or a plane parallel to the horizontal surface shown in FIG. 1*c*, maximizes fluid flow along the surface of the angled divider component 154 resulting in the optimal attitude for angled dispensing. Subsequent references to rotation of the travel mug 10 in this manner is hereafter referred to as "optimal rotation." Similarly, subsequent references to fluid flow along the partition 15 should be taken to mean dispensing at the optimal attitude just described.

Figure 1B:
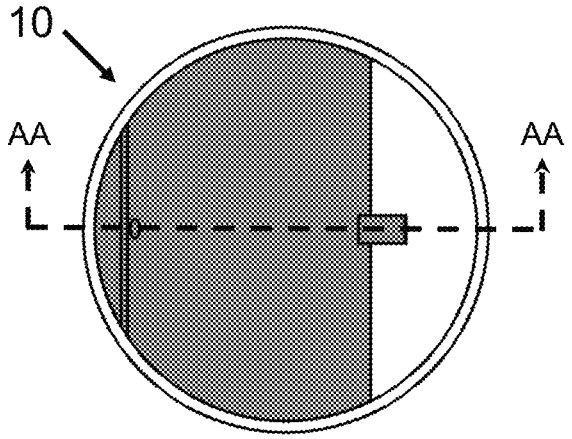
FIG. 1*b* shows, in simplified form, a top view of the travel mug.
Figure 1C:
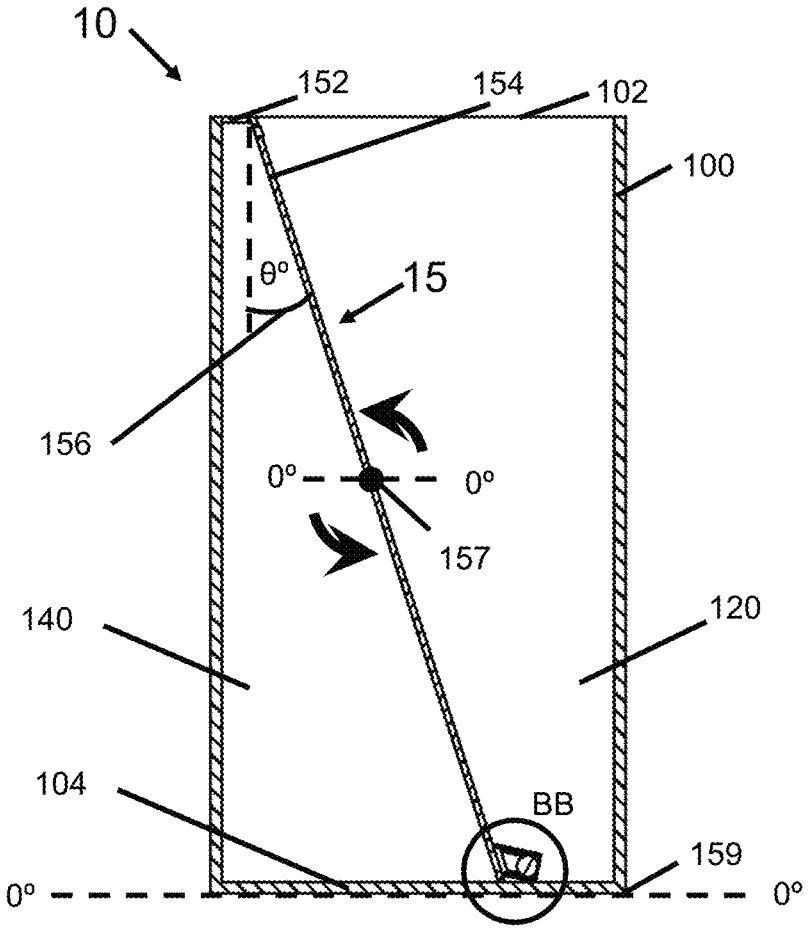
FIG. 1*c* shows, in simplified form, a vertical cross-section view of the travel mug taken approximately along line AA-AA in FIG. 1*b;*
Figure 1C:
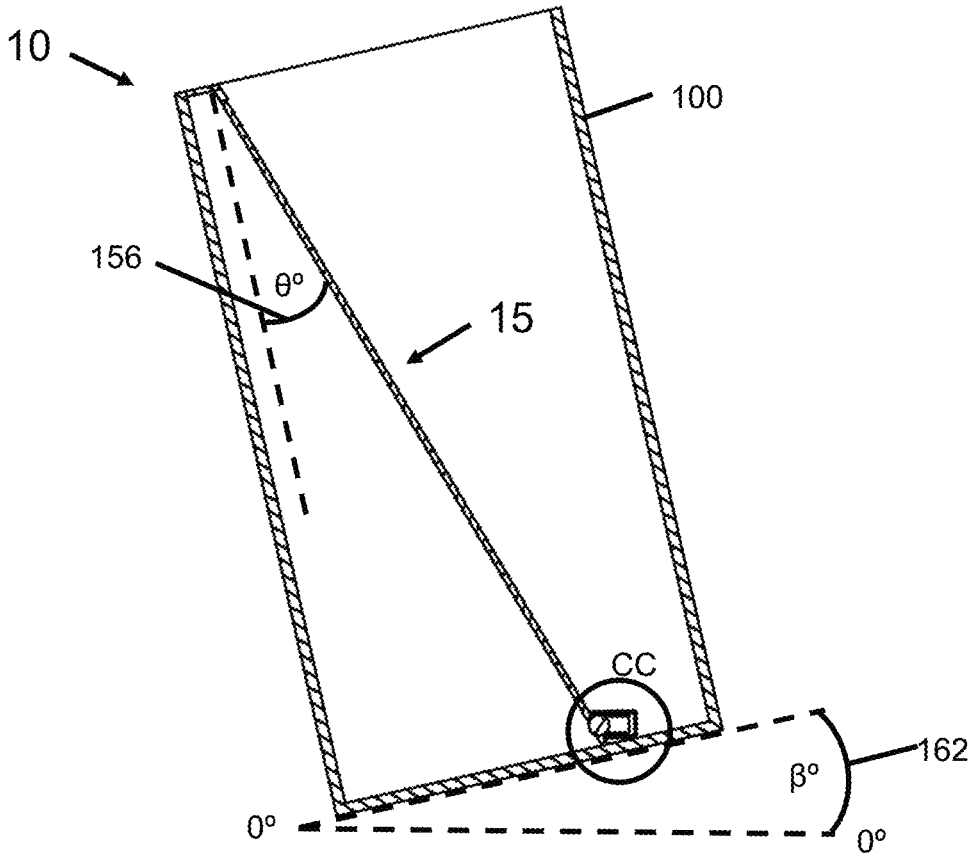

FIG. 1*c*' shows, in simplified form, a vertical cross section of the travel mug taken approximately along the line AA-AA in FIG. 1*b* and tipped at an angle β° 162 from horizontal.

As a result of the disposed partition 15, tipping the travel mug 10 at an angle β° 162 so that fluid flow occurs along the angled partition 15 creates an effective tipping angle of β° 162+θ° 156. Without the advantage of the partition 15, as more fluid within the vessel 100 is dispensed, steeper and steeper tipping of the travel mug 10 is required in order to continue a comfortable fluid flow rate and dispensing pressure. At some point during dispensing, the travel mug 10 must be tipped at an angle beyond β° 162 equal to 90°, not only to empty the entire contents of the vessel 100 but to maintain customary flow rate and pressure. At such an angle, the line of sight is blocked and/or possible distress can occur to the head and neck. Angled dispensing eliminates these two shortcomings since the travel mug 10 with partition 15 only needs to be tipped to an angle β° 162 equal to 90°−θ° 156 in order to empty the entire vessel 100 with disposed partition 15. A third shortcoming of conventional travel mugs which is eliminated by incorporating angled dispensing is the inability to dispense the entire contents of the travel mug 10 if the maximum tipping angle is constrained (e.g., dispensing in a confined space).

Figure 2A:
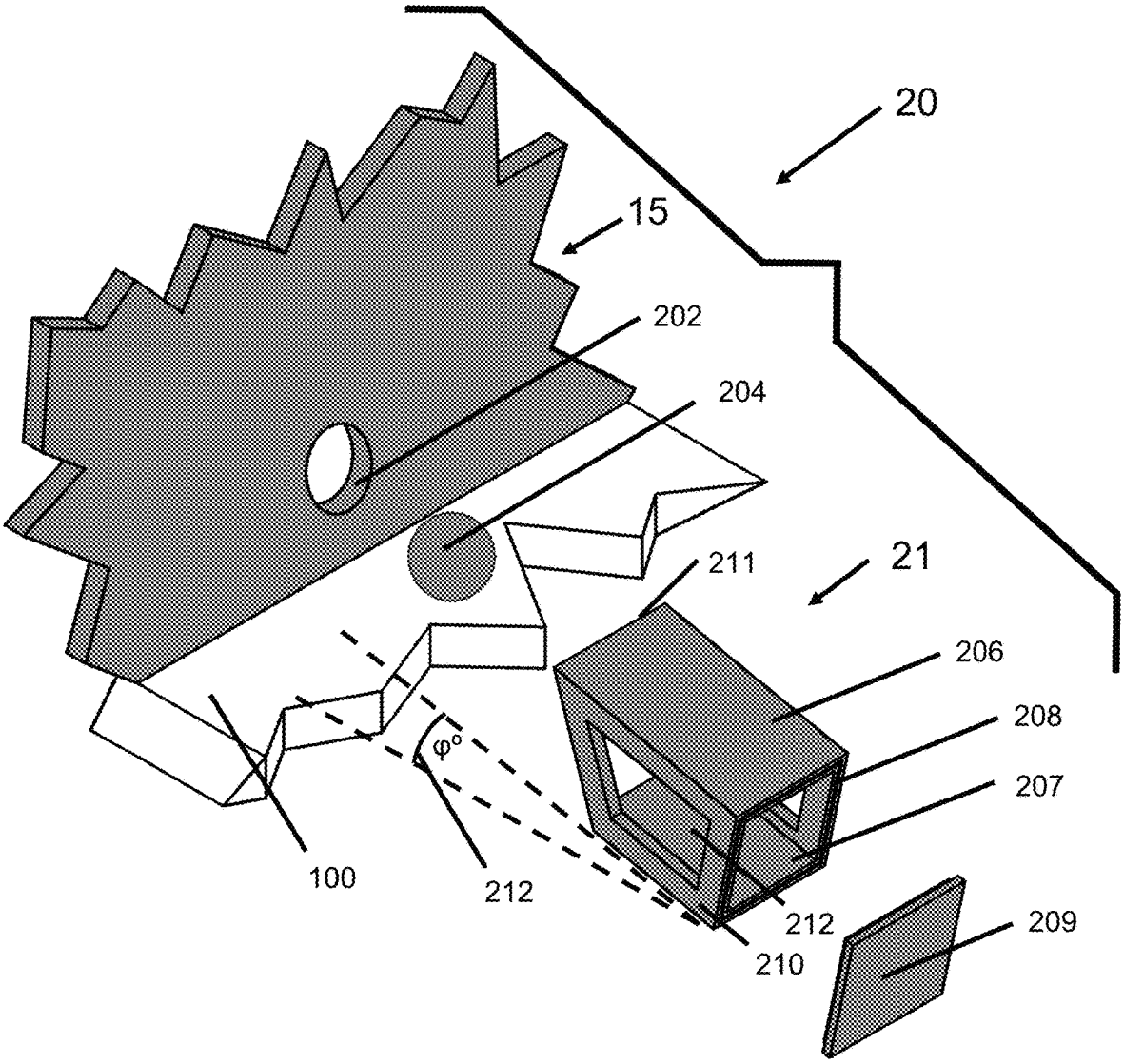
FIG. 2*a* shows, in simplified form, an exploded view of the flow restrictor.

We will now turn our attention to describing a representative flow restrictor 20 as can be seen in FIG. 2*a*. FIG. 2*a* shows, in simplified form, an exploded view of the flow restrictor 20. In general, a flow restrictor 20 comprises two components: 1) a blockable fluid flow path and 2) a path blocker.

In FIG. 2*a*, we see one embodiment of the flow restrictor 20 where the blockable fluid flow path is a circular hole 202 passing through the partition 15 and the fluid blocking mechanism is a ball bearing 204.

The circumference of the hole 202 is sized to be slightly less than that of the circumference of the ball bearing 204. As the ball bearing 204 rolls over the hole 202, the ball bearing 204 drops into but not through the hole 202 and blocks fluid flow across the partition 15. With the hole 202 blocked, the flow restrictor 20 is considered engaged and disengaged otherwise. The ball bearing 204 is constructed of sufficiently dense materials (e.g., rubberized, steel) to allow the ball bearing 204 to pass freely through representative fluids (e.g., coffee with cream and sugar) when the ball bearing 204 is subject to motion under the force of gravity.

A cage 21 and cage cap 209 are introduced to facilitate alignment of the ball bearing 204 to the hole 202 so that blocking and unblocking of the hole 202 occurs as required. The cage 21, comprises a hollow rectangular tube with right and left cage sides 210, a cage top 206, a cage bottom 207, a square cage back 208, and a rectangular cage front 211 that is flush and sealed to the partition surface 15.

The cage cap 209 is removably disposed onto the cage back 208 using a snap fit. The cage cap 209, when removed, allows for easy installation and removal of the ball bearing 204, and, when disposed, prevents the ball bearing 204 from exiting the cage back 208. However, if the cage back 208 were configured to allow the ball bearing 204 to be press fit into the cage 21 then the cage cap 209 could be eliminated entirely.

The cage bottom 207 is angled, φ° 212, downward with respect to horizontal when the vessel 100 is upright and at rest. The cage sides 210 and the diagonal of the cage 21, as taken from the cage back 208, are slightly longer than the diameter of the ball bearing 204. The cage front 211 is attached to the partition 15 at a location centered on the circular hole 202.

The cage top 206 and cage bottom 207 are continuous solid surfaces to prevent the ball bearing 204 from exiting the cage 21 at either the cage top 206 or cage bottom 207. The continuous solid surface at the cage bottom 207 allows the ball bearing 204 to roll smoothly along the cage bottom 207. The cage sides 210 have openings 212 to allow fluid to flow freely into and out of the cage 21 but are sized small enough to prevent the ball bearing 204 from escaping.

The cage 21 confines the general motion of the ball bearing 204 along a line, angled φ° 212 downward with respect to horizontal when the vessel 100 is upright and at rest, originating at the center of the hole 202 and terminating at the disposed cage cap 209. It is should be noted that the importance not being the particular configuration of the cage 21, but that the cage 21 both limits and guides the movement of the ball bearing 204. A cylindrical tube with similar features to that of the rectangular tube just described could have just as easily been used.

Construction materials used for the cage 21 and cage cap 209 are similar to that of the partition 15, hardened plastic or metal, and representative techniques for sealing the cage 21 to the partition 15 include but are not limited to the following: 1) forming the two components as a single component through molding or 2) connecting the components with solvents, glue, or welding.

Figure 2B:
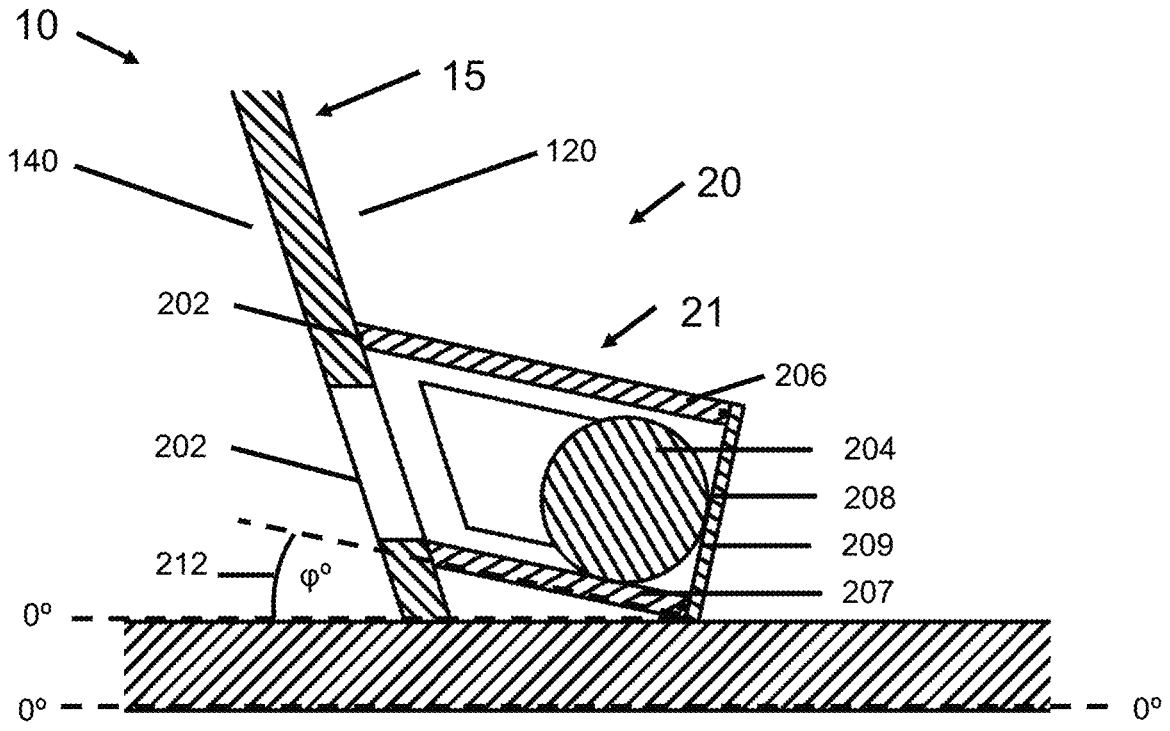
FIG. 2*b* shows, in simplified form, a detailed vertical cross-section view of the disengaged flow restrictor as taken from BB in FIG. 1*c* with the travel mug upright and at rest.
Figure 2B:
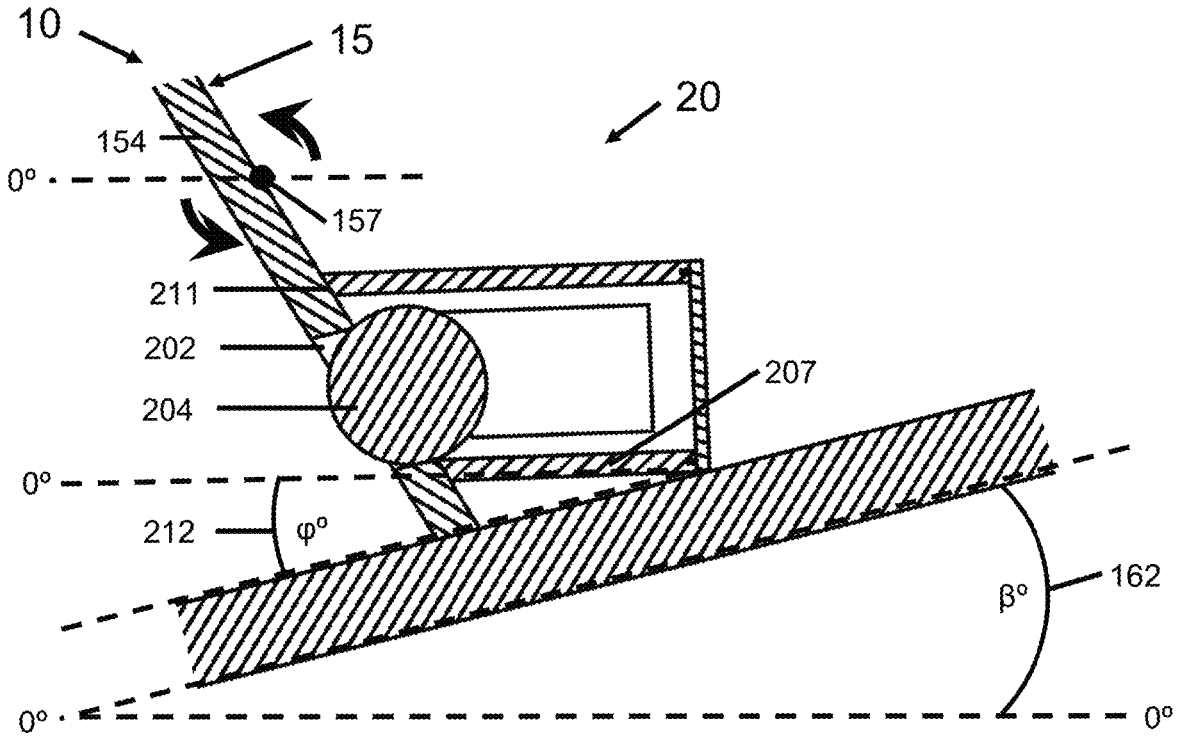

FIG. 2*b* shows, in simplified form, a detailed vertical cross-section view of the flow restrictor 20, disengaged, as taken from BB in FIG. 1*c* with the travel mug 10 upright and at rest. With the travel mug 10, upright and at rest, the ball bearing 204 is situated at the back of the cage 208 and positioned against the cage cap 209. Fluid from the chamber with the higher vertical level will flow through to the other chamber until chamber equalization is attained.

FIG. 2*b*' shows, in simplified form, a detailed vertical cross-section view of the engaged flow restrictor 20 as taken from CC in FIG. 1*c*' with the travel mug 10 tipped at an angle β° 162 relative to horizontal.

Because the cage bottom 207 is angled downward, φ° 212, with respect to horizontal when the travel mug 10 is upright and at rest, optimal rotation of the travel mug 10 beyond an angle β° 162 equal to the angle φ° 212 will cause the ball bearing 204 to roll forward to the cage front 211 and drop slightly into the hole 202 blocking fluid flow across the partition 15. Fluid flow will continue to be blocked until the travel mug 10 is tilted back to an angle β° 162 less than φ° 212 from horizontal.

The configurable angle, φ° 212, is easily understood to be an engagement angle and determines the degree of tipping required to engage/disengage the flow restrictor 20. In most cases, the engagement angle would be set relatively small (e.g., between 10° and 25°), but not so small as to disregard the challenges of filling on a crooked table (e.g., between 0° and 5°) or needing to tilt (e.g., between 5° and 10°) the travel mug 10 when filling from large coffee urns found at convenience stores where there is insufficient space to fill the travel 10 mug without tipping it. The engagement angle could be configured to be large, up to 90°, to restrict additional amounts of fluid from being dispensed after a set amount is reached with direct application to medicines and other monitored fluids.

Figure 3A:
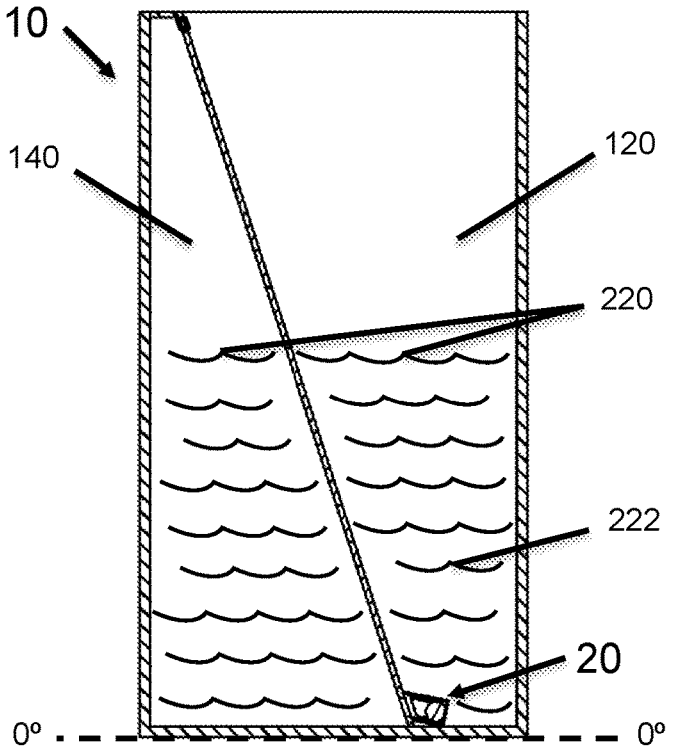
FIG. 3*a* shows, in simplified form, a vertical cross-section view of the travel mug partially filled with fluid, flow restrictor disengaged.
Figure 3A:
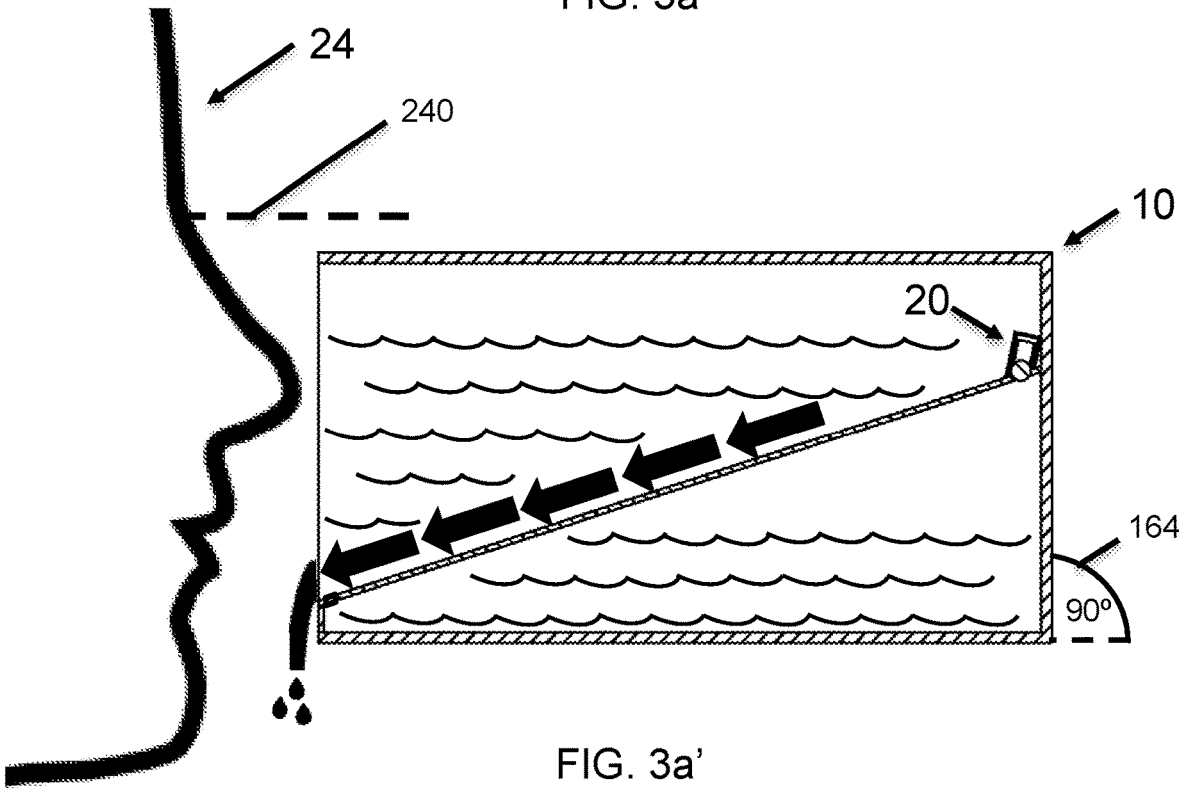

FIG. 3*a* shows, in simplified form, a vertical cross-section view of the travel mug 10 at rest, partially filled with fluid 222, and the flow restrictor 20 disengaged. With the flow restrictor 20 disengaged, vertical fluid levels are equalized 220 across both chambers 120, 140.

FIG. 3*a*' shows, in simplified form, a vertical cross-section view of the travel mug 10 partially filled with fluid, positioned for dispensing at an angle of 90° 164 from horizontal. At this position, the flow restrictor 20 is engaged.

The silhouette portrait 24 in FIG. 3*a*' shows an unobstructed horizontal line of sight 240 when the partially filled travel mug 10 is tipped at 90° 164 from horizontal. The unobstructed horizontal line of sight 240 is highly advantageous while simultaneously drinking from the travel mug 10 and operating a vehicle or walking on a crowded sidewalk as it helps to lower collisions that may otherwise result from obstructed vision. Angled dispensing in the aforementioned manner is also highly advantageous for users with physical disabilities like arthritis or wry neck where tipping the head and neck backward can be painful if not physically impossible.

It is to be understood and appreciated that the function of the flow restrictor is illustrative and achievable through a variety of different designs. One such embodiment is to create an opening at the bottom of the partition and place a spring-controlled, hinged panel over the opening. The hinged panel opens and closes by engaging and disengaging an actuator that can be built as a separate control or built into a standard lid with a spring-controlled lid port access as taught in U.S. Pat. No. 3,739,938 and herein incorporated by reference. In either construction of the actuator, when it is engaged, the panel seals the opening at the bottom of the partition blocking fluid from crossing the fluid reservoir and fluid dispensing chambers. And when the actuator is released, the panel unseals from the partition allowing fluid to flow freely between the two chambers.

A second, alternative embodiment of the flow restrictor utilizes a microprocessor-controlled electromechanical valve and attitude sensor. In this embodiment, a hole is made in the partition near or at the bottom of the partition. An electromechanical valve is placed in proximity to the hole so that when the attitude sensor detects the travel mug is being positioned in a direction to dispense, the microprocessor signals the electromechanical valve to engage and block fluid from crossing from one chamber to the other. Once the attitude sensor detects the travel mug is upright and at rest, the microprocessor signals the electromechanical valve to disengage and allow fluid to flow between the two chambers.

Such variations of the flow restrictor are intended to be within the scope of the invention as broadly described and claimed herein. The importance being not the particular configuration of the flow restrictor but that the flow restrictor impedes fluid flow across the fluid reservoir and fluid dispensing chambers when the travel mug is positioned for dispensing and allows fluid flow across the two chambers when the travel mug is upright and at rest.

Having described a vessel with a fixed partition, we will now turn our attention to a vessel with a removable partition. Leftover fluid (e.g., coffee with cream and sugar) remaining in the fluid reservoir chamber can lead to the growth of bacteria and mold, so it is important to be able to thoroughly clean, not only the full interior of the travel mug, but both sides of the partition as well. Introducing a removable partition is advantageous as it allows the partition to be separated and removed from the vessel so the vessel and partition can be cleaned and sanitized. An additional advantage of a removable partition is that once removed, it is easy to discard any remaining fluid inside the vessel thus saving time and ensuring the entire contents have been removed. A further advantage of the removable partition over the fixed partition is that it can be replaced if it becomes damaged.

As a consequence of introducing a removable partition, it is important to consider methods for sealing the partition edges to the vessel interior when the removable partition is disposed into the vessel to prevent leakage across chambers. One such sealing method bevels the partition edges so that when the removable partition is disposed into the vessel the beveled edges form a friction fit preventing fluid from flowing between the chambers. Another method for sealing the removable partition edges to the interior of the vessel, once disposed, includes affixing a waterproof, pliable material to the partition edges or coating the interior of the vessel with a waterproof, pliable material. In either case, when the partition is inserted into the vessel a leak proof seal is formed at the partition edges and the vessel interior.

It is instructive to note that the seal at the partition edges need not necessarily be waterproof. In fact, a minimally leaky partition could advantageously eliminate the need for a separate aperture, as a minimally leaky partition could act as an air flow. However, one needs to be careful that the leaks are not so great as to negate the benefits of adding a partition.

A further option for a removable partition includes constructing a sliding, removable partition designed to slide within a channel disposed within the vessel and attached to the interior walls and bottom of the vessel such that the partition and channel together form a leak proof seal between the chambers when the partition is fully disposed within the vessel. Fluid flow between chambers is controlled by a mechanism that slides the partition up and down. At rest, the partition is raised off the vessel bottom and above the bottom channel allowing fluid flow between the chambers. When ready to dispense, the control mechanism is activated and seals the bottom edge of the partition within the channel at the bottom of the vessel enabling angled dispensing.

Alternatively, the sliding partition just described can be fully disposed into the vessel within the channel such that it forms a leak proof seal between chambers. Fluid flow between the chambers is then controlled by a mechanism that opens and closes a hinged door located near the bottom of the partition but above the bottom channel. At rest, the hinged door is open allowing fluid to flow between the chambers. When ready to dispense, the control mechanism is activated and the hinged door is closed and sealed enabling angled dispensing. The importance being that fluid flow between the chambers is restricted under certain conditions and unrestricted under others. Such variations are therefore intended to be within the scope of the invention as broadly described and claimed herein. We now turn our attention to a recessed, removable lid.

Having described the benefits of a removable partition, we turn our attention to the need to minimize splashing and to reduce spillage of vessel contents. It is therefore advantageous to introduce a recessed, removable lid. (Note: Subsequent use of lid is to be understood to mean recessed, removable lid.) We will then further employ this same lid to incorporate travel mug optimization and safety features. It is important to note that the function of the lid and the subsequent fluid flow optimization elements and safety features, while being important aspects of the travel mug, are not required to be built into the lid and can be incorporated into other components of the travel mug or built separately and connected to the travel mug.

Figure 4A:
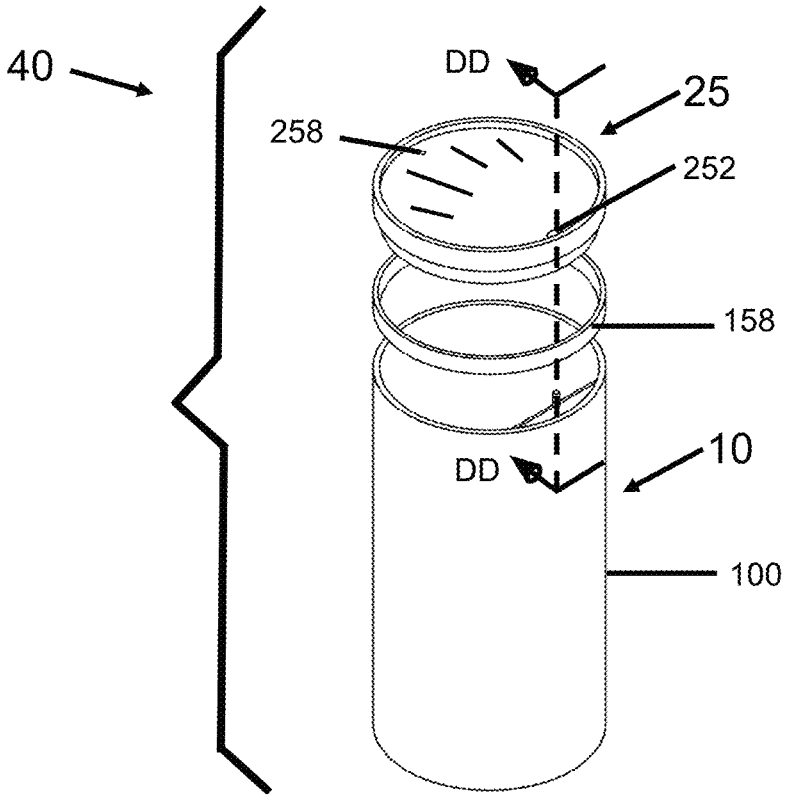
FIG. 4*a* shows, in simplified form, an exploded view of the travel mug, a vessel shoulder, and a recessed, removable lid with a dispensing port and a lid vent.

FIG. 4*a* shows, in simplified form, an exploded view of the travel mug with attached lid 40 and builds upon the travel mug 10 discussed up to this point. The travel mug with attached lid 40 comprises: 1) the travel mug 10, 2) a vessel shoulder 158, and 3) a lid 25 comprising: a) a dispensing port 252 and b) a lid vent 258. Both the lid 25 and vessel shoulder 158 are typically constructed of relatively hard material, metal or plastic, but the choice of material can be any material that produces the desired functionality.

The lid 25 is removably disposed and friction fitted on and within the vessel shoulder 158. (Note: the vessel shoulder 158 is represented as a separate component for the purpose of this discussion; however, it would typically be formed integrally with the vessel 100 or otherwise be attached to the top of the vessel 100, such that together they form a contiguous non-leaking unit.)

The lid vent 258 is positioned diametrically opposite the dispensing port 252 and allows for exiting and venting of steam, air, carbonation, etc. in order to depressurize the closed vessel 100 when filled with fluid and to prevent a vacuum from forming while fluid is being dispensed.

Figure 4B:
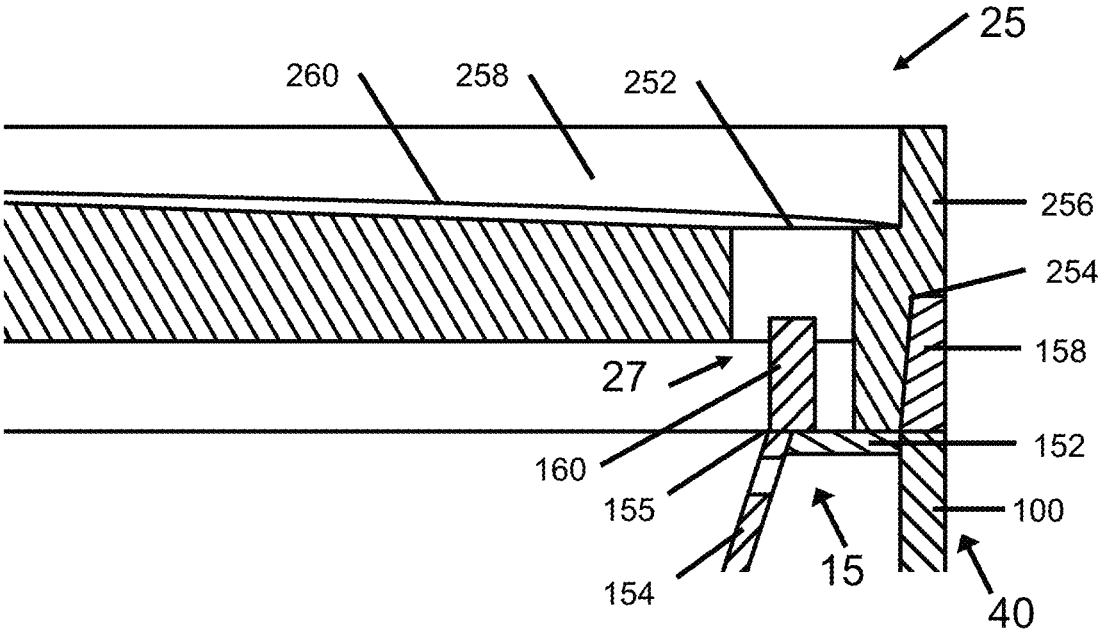
FIG. 4*b* shows, in simplified form, a detailed vertical cross-section of the travel mug, recessed, removable lid, and a partition-lid alignment mechanism taken approximately along the line DD-DD in FIG. 4*a;*

FIG. 4*b* shows, in simplified form, a detailed vertical cross-section of the travel mug with attached lid 40 and a partition-lid alignment mechanism 27 taken approximately along the line DD-DD in FIG. 4*a*.

The lid 25, with annular side walls 256, incorporates an inward step 254, and is sized and shaped to be friction fitted onto and within the vessel shoulder 158.

The lid 25 includes a central recess 258 with top surface 260 sloping towards the dispensing port 252. As a consequence, any fluid that remains in the recess 258 after dispensing or enters the recess 258 as a result of the travel mug with attached lid 40 being jostled will reenter the vessel 100 through the dispensing port 252.

It is to be understood and appreciated that the function of the aforementioned friction fit configuration used to couple the lid 25 to the vessel shoulder 158 is illustrative and could be provided by a variety of different designs. Other methods for securing the lid to the vessel include screw threads and snap fittings. Such variations are therefore intended to be within the scope of the invention as broadly described and claimed herein.

As previously discussed, optimal dispensing occurs when the travel mug 10 and the travel mug with attached lid 40 are positioned so that fluid flow is directed along the planar surface of the angled divider component 154. Also previously discussed, the partition 15 is represented as being made up of two components: 1) an angled divider component 154 and 2) a cap 152. The edge where the angled divider component 154 and the cap 152 meet is referred to as the partition intersection 155. To maintain the benefits of optimal dispensing while simultaneously benefitting from a lid 25, it is ideal that the dispensing port 252 be in alignment with the partition intersection 155 so that fluid exiting the vessel 100 is directly received by the dispensing port 252. As such, it is advantageous to introduce a mechanism to align the partition intersection 155 and the dispensing port 252. Details of a partition-lid alignment mechanism 27 are now given.

An exemplary partition-lid alignment mechanism 27 consists of an alignment post 160 affixed to the partition cap 152 with sufficient length to extend partially into the dispensing port 252 when the lid 25 is securely affixed and attached to the interior wall of the vessel shoulder 158. With this construction, the lid 25 can only be securely disposed inside and onto the vessel shoulder 158 if the alignment post 160 extends into the dispensing port 252. The partition-lid alignment mechanism 27 ensures that fluid is dispensed in a manner to achieve the maximum benefits of angled dispensing.

It is to be understood and appreciated that the function of the partition-lid alignment mechanism is illustrative and achievable through a wide variety of different designs.

One such embodiment for aligning the partition to the dispensing port connects the lid along a notch cut into the exterior wall of the lid with a protrusion on the vessel shoulder so that when the lid is disposed onto and inside the vessel shoulder, the dispensing port aligns with the partition intersection. Another such embodiment includes attaching the lid to the vessel or vessel shoulder via a living hinge.

A third, alternative embodiment for aligning the partition to the dispensing port is to permanently affix the partition to the lid so that the dispensing port permanently aligns with the partition intersection. This embodiment provides all of the benefits of a removable partition with partition-lid alignment.

Such variations of partition-lid alignment mechanisms are intended to be within the scope of the invention as broadly described and claimed herein. The importance being not the particular configuration of the partition-lid alignment mechanism but that aligning the partition intersection with the dispensing port allows for optimized dispensing by directing fluid flow along the partition during dispensing.

We will now turn our attention to additional mechanisms to help safeguard the user. The first mechanism we will discuss is a mechanism to insure that the partition is properly in place prior to using the travel mug.

In order to benefit from angled dispensing, the partition must be disposed into the travel mug. With the fixed partition, this is always the case. However, with the removable partition and lid, angled dispensing and its inherent features are easily circumvented simply by not inserting the partition prior to securing the lid. It is therefore advantageous to introduce a partition engagement lock to slow or block fluid from exiting the travel mug and effectively disabling the travel mug from dispensing, thereby, safeguarding the user from failing to insert the partition prior to use.

Figure 5A:
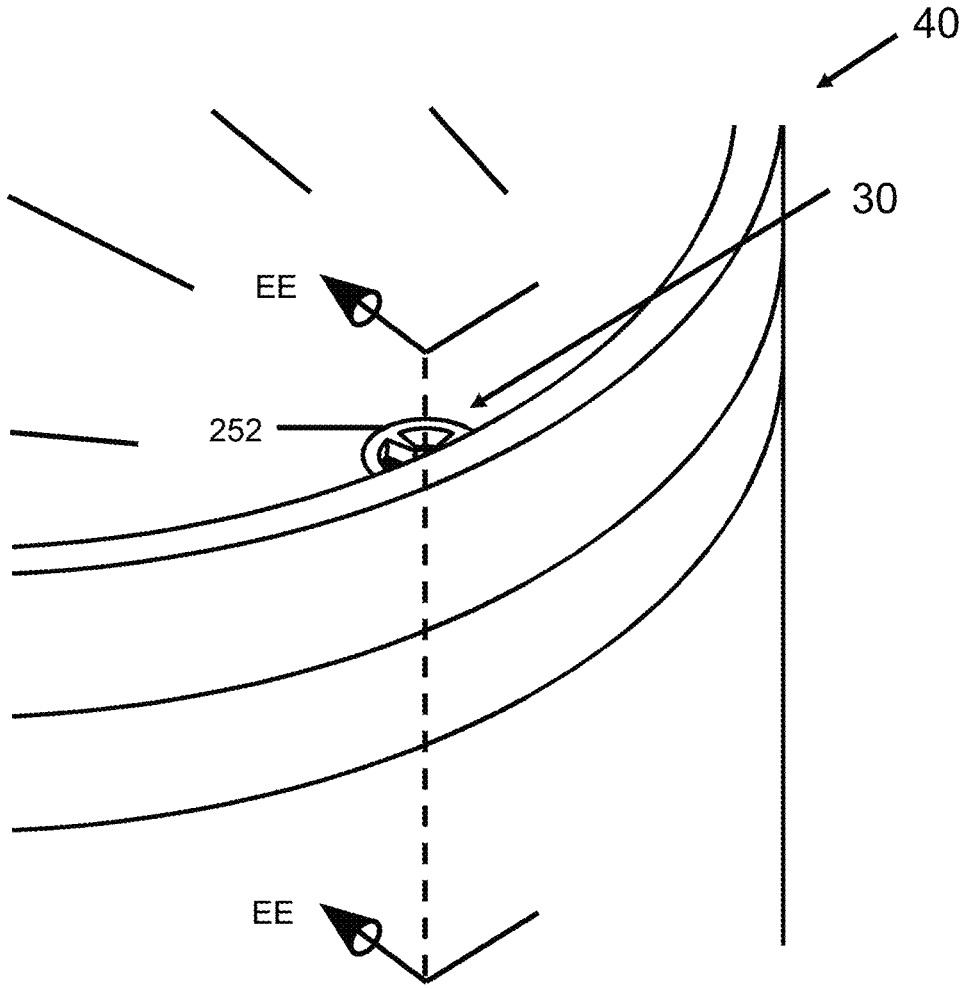
FIG. 5*a* shows, in simplified form, a partial perspective view of the travel mug with attached lid and a partition engagement lock disposed inside the dispensing port.

FIG. 5*a* shows, in simplified form, a partial perspective view of the travel mug with attached lid 40 and a partition engagement lock 30 disposed inside the dispensing port 252.

Figure 5B:
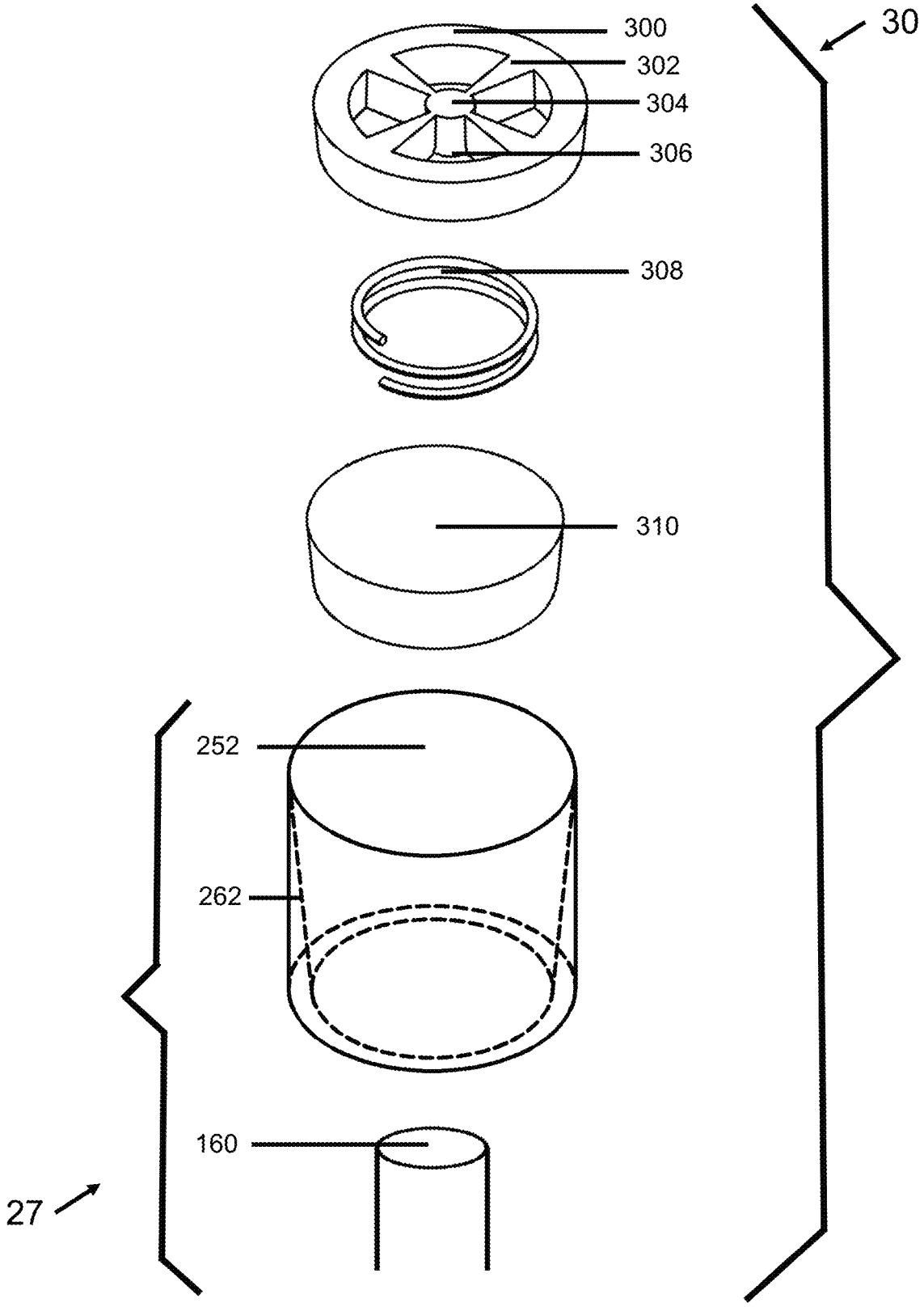
FIG. 5*b* shows, in simplified form, an exploded view of the partition engagement lock and partition-lid alignment mechanism.

FIG. 5*b* shows, in simplified form, an exploded view of the partition-lid alignment mechanism 27 and partition engagement lock 30. Having previously discussed the partition-lid alignment mechanism 27, we now turn our attention to, and build upon, the partition-lid alignment mechanism 27 to create a partition engagement lock 30. Details of the partition engagement lock 30 are now provided.

A spring cover 300, located and affixed to the top and interior of the dispensing port 252, is tapered slightly downward and comprises a plurality of radially extending spokes 302 which are spaced from one another and interconnect to a central cylinder 304 and the side wall of the dispensing port 252. Spaces between the spokes define fluid access holes 306 through which fluid may exit and reenter the dispensing port 252.

An inward bevel 262 connecting to the dispensing port 252 wall originates at the top planar surface of the dispensing port 252 and terminates at the bottom planar surface of the dispensing port 252.

A spring 308 is positioned between the spring cover 300 and a bevel plug 310. The bevel plug 310 is sized and shaped to match the bottom of the bevel 262 wall and is free to move vertically within the dispensing port 252 between the spring 308 and the planar bottom surface of the dispensing port 252.

At rest, the spring 308 exerts a downward force on the bevel plug 310 sufficient to seal the bevel plug 310 to the bevel 262 wall, effectively blocking the flow of fluid through the dispensing port 252.

Figure 5C:
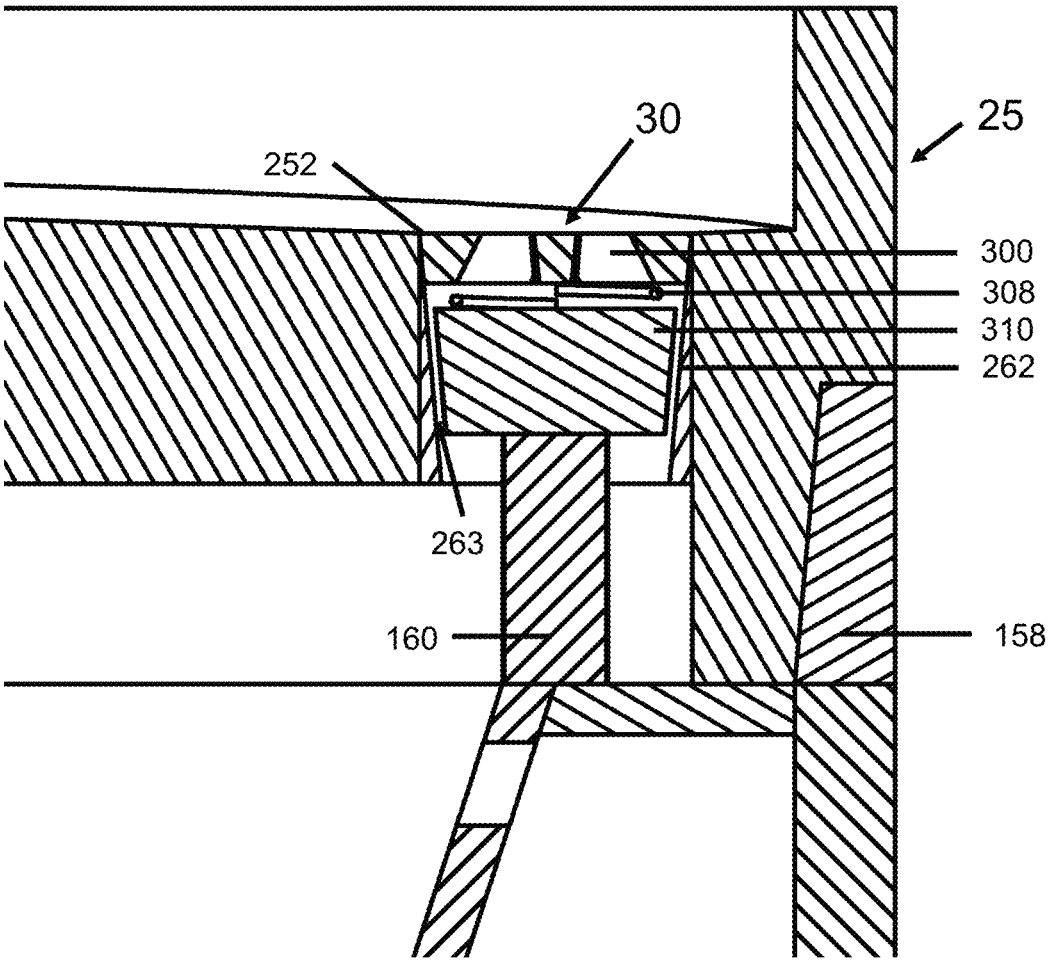
FIG. 5*c* shows, in simplified form, a detailed vertical cross-section of the partition engagement lock, disengaged, taken approximately along the line EE-EE in FIG. 5*a;*

FIG. 5*c* shows, in simplified form, a detailed vertical cross-section of the partition engagement lock 30, disengaged, taken approximately along the line EE-EE in FIG. 5*a*. With the lid 25 aligned and securely affixed to the vessel shoulder 158, as described above, the alignment post 160 exerts an upward force on the bevel plug 310 and spring 308 sufficient to move the bevel plug 310 upward and create a space 263 between the bevel 262 wall and the bevel plug 310. The space 263 created between the bevel 262 wall and bevel plug 310 allows fluid to flow alongside the bevel 262 wall and through the dispensing port 252 via the spring cover 300.

It is to be understood and appreciated that the function of the partition engagement lock is illustrative and achievable through a wide variety of different designs.

One such design for slowing or blocking fluid from exiting the vessel if the partition is not installed utilizes a microprocessor-controlled electromechanical valve and contact sensors. The electromechanical valve is disposed within the dispensing port and connects to the microprocessor. By default the valve is closed. Conductive sensors are applied to the bottom surface of the lid and a conductive material is applied to the partition cap. Once the lid is lowered onto and into the vessel, the microprocessor tests for conductivity between the lid and partition cap. If conductivity is determined, the dispensing port valve opens. If no connectivity is detected, the valve remains closed.

A second, alternative embodiment permanently affixes the partition to the lid, forming a single partition-lid component eliminating the need for partition-lid alignment and partition engagement lock safeguards. Both the single component partition-lid and the multicomponent partition and lid safeguards have their advantages. By keeping the partition and lid separate, travel mug designers and manufacturers may be able to more easily retrofit existing travel mugs with full volume angled dispensing. New designs for travel mugs may be more amenable to a single component design. We now turn our attention to a steep tip safety mechanism.

A benefit of full volume angled dispensing, previously discussed, provides accustomed fluid flow and pressure at smaller tipping angles. These smaller tipping angles allow for dispensing without the risk of obstructing the horizontal line of sight. This benefit, however, does not prevent someone from tipping the travel mug so steeply as to effectively defeat the safety advantage of angled dispensing. It is therefore advantageous to introduce a steep tip flow throttle to discourage excess tipping during dispensing.

Figure 6A:
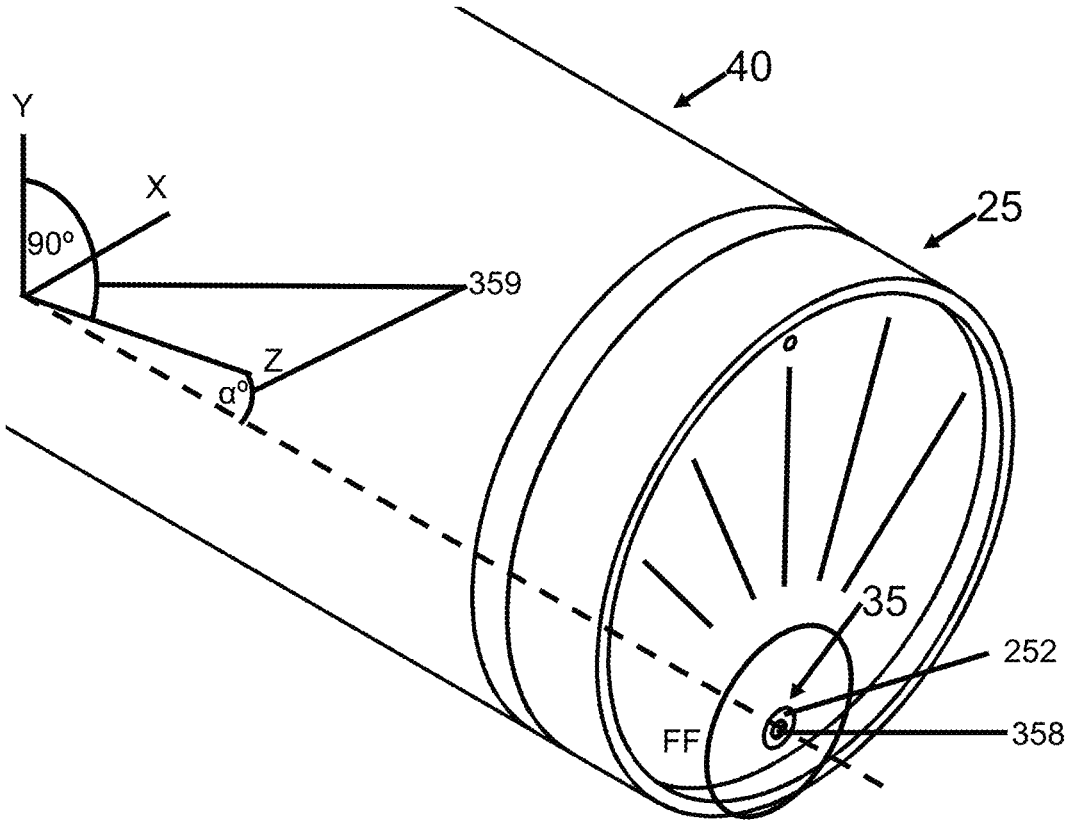
FIG. 6*a* shows, in simplified form, a partial perspective view of the travel mug with attached lid tipped at 90°+α° with an engaged steep tip flow throttle blocking the dispensing port.

FIG. 6*a* shows, in simplified form, a partial perspective view of the travel mug with attached lid 40 tipped at 90°+α° 359 from horizontal. At this angle, an engaged steep tip flow throttle 35 with component throttle ball bearing 358 blocks fluid flow through the dispensing port 252. Details of the steep tip flow throttle 35 are now given.

Figure 6B:
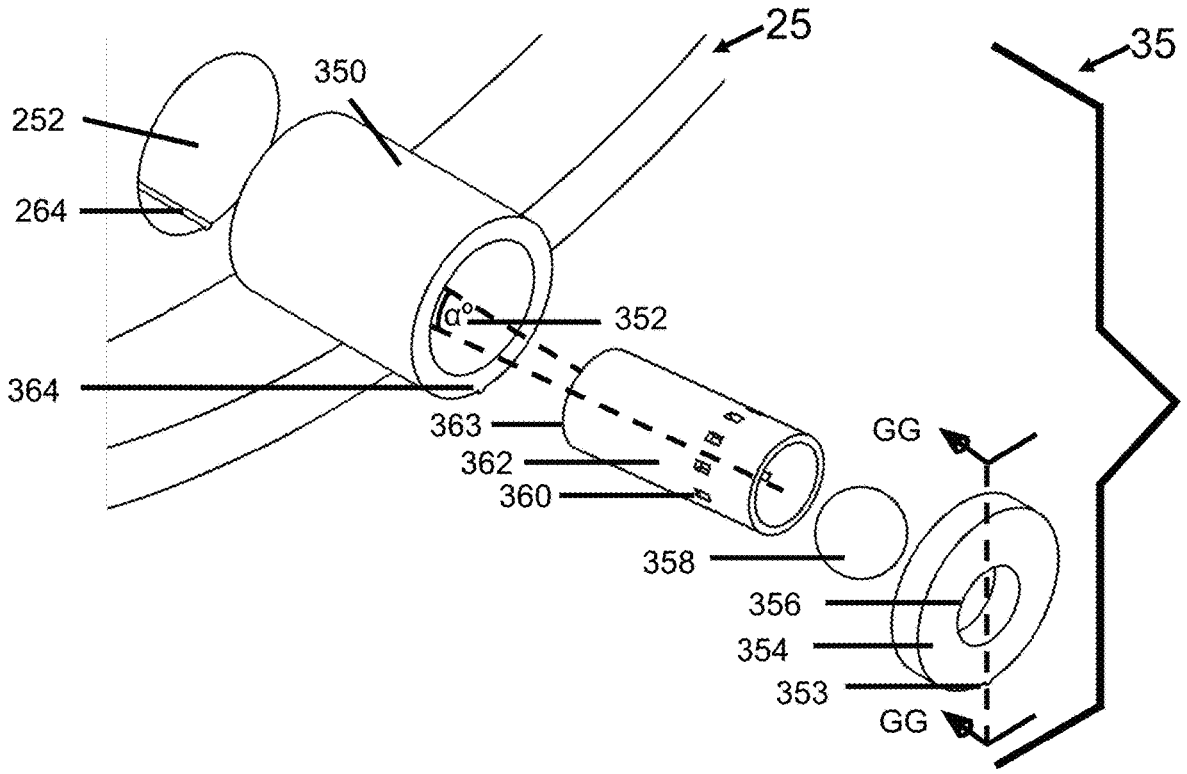
FIG. 6*b* shows, in simplified form, an exploded view of the steep tip flow throttle as taken from FF in FIG. 6*a;*

FIG. 6*b* shows, in simplified form, an exploded view of the steep tip flow throttle 35 as taken from FF in FIG. 6*a*. The steep tip flow throttle 35, disposed inside the dispensing port 252, consists of an outer tube 350, an inner tube 362 disposed inside the outer tube 350 with both tubes constructed of hardened or pliable plastic, a throttle ball bearing 358, and a throttle cap 354.

The outer tube 350 with outside diameter slightly smaller than the dispensing port 252 diameter is disposed inside the dispensing port 252. The outer tube 350 and dispensing port 252 are connected along a tube guide protrusion 364 and a dispensing port notch 264 forming a friction fit, leak proof seal along the wall of the dispensing port 252.

The length of the outer tube 350 together with the throttle cap 354 are sized to fit entirely within the dispensing port 252. (Note: To dispose the steep tip flow throttle 35 inside the dispensing port 252 together with the aforementioned partition-lid alignment mechanism and partition engagement lock requires the total length of combined components to be less than the length of the dispensing port 252.)

An inner tube 362 with closed back surface 363 and outside diameter slightly smaller than the inside diameter of the outer tube 350 is disposed inside the outer tube 350 and affixed to the outer tube 350 inner wall so the back of the outer tube 350 and the back 363 of the inner tube 362 are bounded by the back planar surface of the outer tube 350. The inner tube 362 is disposed inside the outer tube 350 in such a fashion as to form an overtip angle $\alpha°$ 352 relative to the tube guide protrusion 364 of the outer tube 350, that is, the inner tube 362 is tipped upward relative to the outer tube 350. The front surface of the inner tube 362 is bounded by the front planar surface of the outer tube 350. A plurality of equally spaced tube transfer ports 360 are placed near the front of the inner tube 362 to allow fluid to flow from the outer tube 350 to the inner tube 362 during dispensing.

The throttle ball bearing 358, with diameter slightly less than the inner tube 362 diameter is disposed inside the inner tube 362 and secured from exiting the inner tube 362 by a disposed throttle cap 354. The throttle ball bearing 358 is constructed of material sufficiently dense to allow movement through representative fluid (e.g., coffee with cream and sugar) when the throttle ball bearing 358 is under the force of gravity.

The throttle cap 354, fashioned as a thick washer, typically constructed of hardened or pliable plastic, having exterior diameter slightly smaller than the dispensing port diameter 252 and cap hole 356 with diameter slightly smaller than the throttle ball bearing 358 diameter is disposed inside the dispensing port 252. The throttle cap 354 and dispensing port 252 are connected along the throttle cap guide protrusion 353 and dispensing port notch 264 forming a friction fit, leak proof seal along the wall of the dispensing port 252. Fluid exiting the dispensing port 252 is forced to exit through the cap hole 356.

The back of the throttle cap 354 is flush with the front of the disposed outer and inner tubes 350, 362 and the front of the throttle cap 354 is flush with the top surface of the dispensing port 252. Restrained by the interior wall of the inner tube 362, the closed back surface 363 of the inner tube 362, and the throttle cap 354, the throttle ball bearing 358 is prevented from escaping the inner tube 362 but can roll freely along the interior wall of the inner tube 362.

Figure 6C:
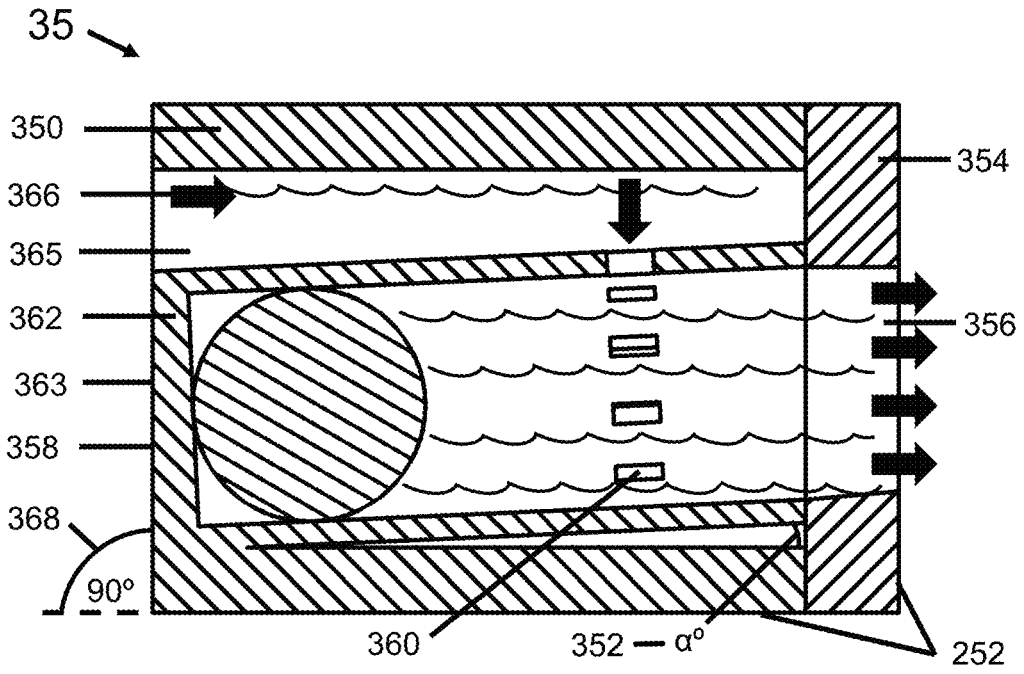
FIG. 6*c* shows, in simplified form, a detailed cross-section view of the disengaged steep tip flow throttle taken along the line GG-GG in FIG. 6*b* tipped at 90° and actively dispensing fluid.
Figure 6C:
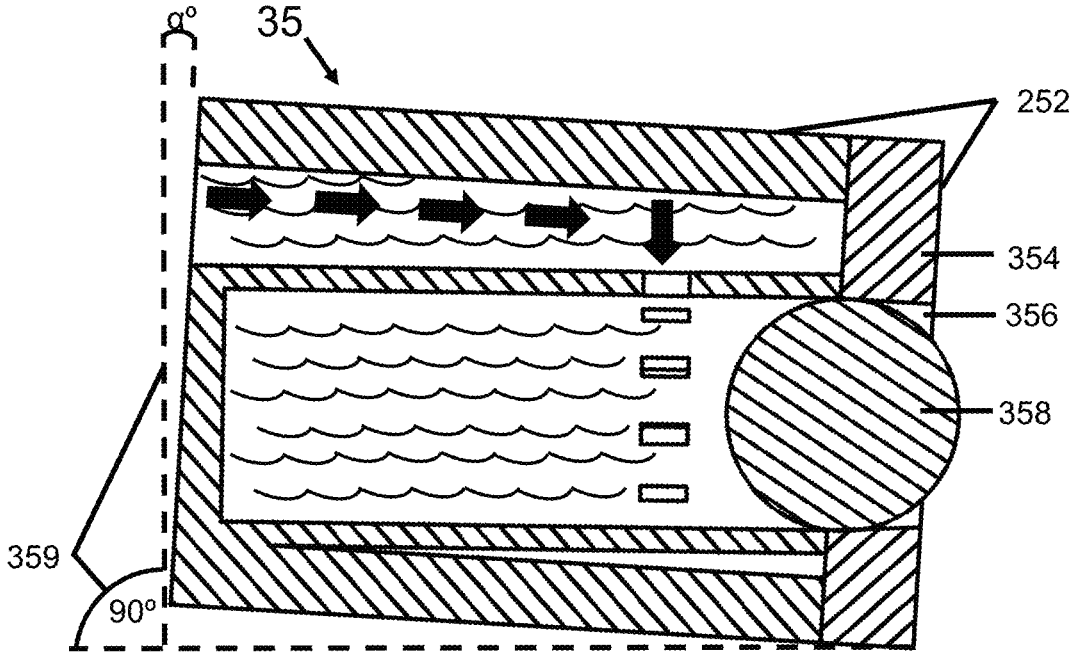

FIG. 6*c* shows, in simplified form, a detailed cross-sectional view of the disengaged steep tip flow throttle 35 taken along the line GG-GG in FIG. 6*b* tipped at 90° 368 from horizontal and actively dispensing fluid.

With the steep tip flow throttle 35 tipped at an angle of 90° 368 relative to horizontal, the throttle ball bearing 358 is at rest and positioned, under gravity, against the solid back wall 363 as a result of the inner tube tipped slightly upward at the overtip angle $\alpha°$ 352 with respect to the outer tube 350. Fluid flow 366 through the cavity 365, formed by volume between the outer and inner tubes 350, 362, passes through the tube transfer ports 360 into the inner tube 362, and exits through the dispensing port 252 at the throttle cap 354 via the cap hole 356.

FIG. 6*c'* shows, in simplified form, a detailed cross-sectional view of the engaged steep tip flow throttle 35 taken along the line GG-GG in FIG. 6*b* blocked from dispensing at a tipping angle $90°+\alpha°$ 359 relative to horizontal.

As the steep tip flow throttle 35 is tipped at an angle beyond $90°+\alpha°$ 359 relative to horizontal, the throttle ball bearing 358 rolls forward under gravity and blocks the cap hole 356, preventing fluid flow through the dispensing port 252 at the throttle cap 354 via the cap hole 356. The configurable angle, $90°+\alpha°$ 359, is recognized as a throttle engagement angle and determines the degree of tipping required to engage/disengage the steep tip flow throttle 35.

Figure 6D:
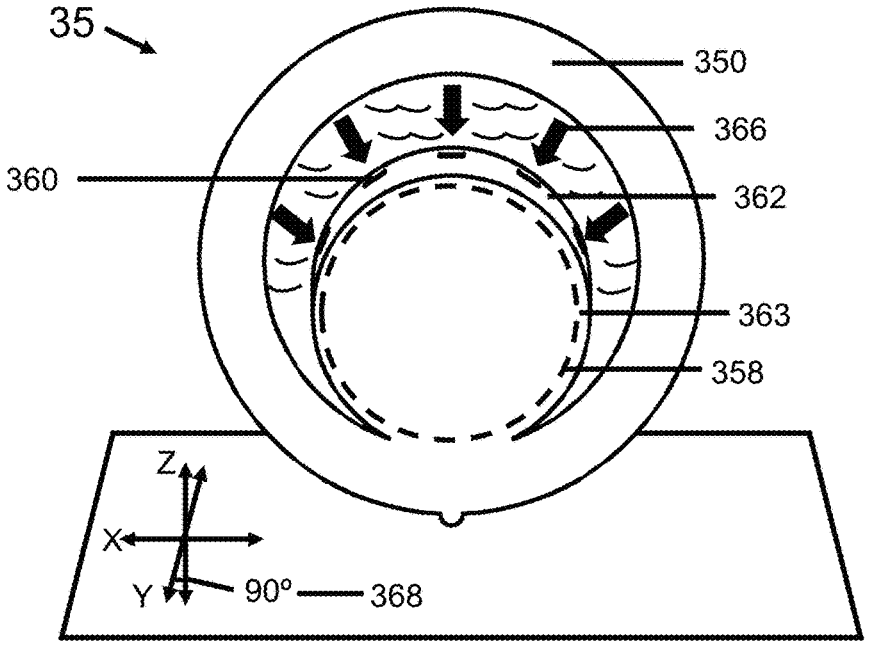
FIG. 6*d* shows, in simplified form, a bottom view of the steep tip flow throttle tipped at 90° for dispensing.

FIG. 6*d* shows, in simplified form, a bottom view of the steep tip flow throttle 35 tipped at 90° 368 from horizontal for dispensing. The importance of requiring an inner tube 362 with a solid back wall 363 is to prevent the throttle ball bearing 358 from rolling forward from resultant fluid pressure as fluid flows 366 through the outer tube 350 and into the inner tube 362 via the tube transfer ports 360. With a solid back wall 363, the throttle ball bearing 358 moves back and forth within the inner tube 362 primarily as a result of gravity and not fluid pressure.

The throttle engagement angle, $90°+\alpha°$ 359 shown in FIG. 6*a* is chosen to be exemplary and represents a configurable threshold. For walking and driving, the throttle engagement angle $90°+\alpha°$ 359, could be set low, (e.g., $95°<90°+\alpha°<100°$) while the throttle engagement angle $90°+\alpha°$ 359 could be set higher (e.g., $101°<90°+\alpha°<110°$) for use by those with physical disabilities involving the head and neck. In another instance, where the fluid point of delivery is important, (e.g., delivery cannot be directly below the travel mug with lid 40 when at rest) the throttle engagement angle could be set to nearly 180°.

As a consequence of the foregoing steep tip flow throttle 35, it will be readily appreciated that attempting to dispense fluid at angles greater than the throttle engagement angle $90°+\alpha°$ 359 will stop fluid flow out of the inner tube 362 if the user attempts to defeat the objective of angled dispensing.

It is to be understood and appreciated that the function of the steep tip flow throttle is illustrative and achievable through a wide variety of different designs. One such embodiment is to fashion the aforementioned flow restrictor shown in FIG. 2*a* for use as a steep tip flow throttle. To benefit from this additional flow restrictor, the partition cap is extended to cover the entire top surface of vessel. The additional flow restrictor is incorporated at a position above the partition near the top of the angled divider with the blockable path being a hole placed through the extended partition cap. The fluid blocking mechanism is a ball bearing constrained to a cage covering the extended partition cap hole and the cage is angled such that when the tipping angle of the travel mug with attached lid extends beyond a configurable throttle engagement angle, the flow restrictor is engaged and restricts fluid from exiting the vessel. At angles less than the configurable throttle engagement angle, the flow restrictor is disengaged and fluid exits the vessel.

A second, alternative embodiment for the steep tip flow throttle utilizes a microprocessor-controlled electromechanical valve and attitude sensor. In this embodiment, the partition cap extends to cover the entire top surface of the vessel. Next, a hole is made in the extended portion of the partition cap adjacent to the fluid reservoir chamber and the angled divider component. The electromechanical valve is placed in proximity to the hole so that when the attitude sensor detects the travel mug being tipped beyond a configurable throttle engagement angle, the microprocessor signals the electromechanical valve to engage and block fluid from crossing the partition cap. Once the attitude sensor detects that the tipping angle of the travel mug falls below a configurable throttle engagement angle, the microprocessor signals the electromechanical valve to disengage to allow fluid to flow out of the travel mug.

Such variations of the steep tip flow throttle are intended to be within the scope of the invention as broadly described and claimed herein. The importance, not being the specific configuration, but that the configuration limits or blocks dispensing at tipping angles beyond a configurable throttle engagement angle.

Figure 7:
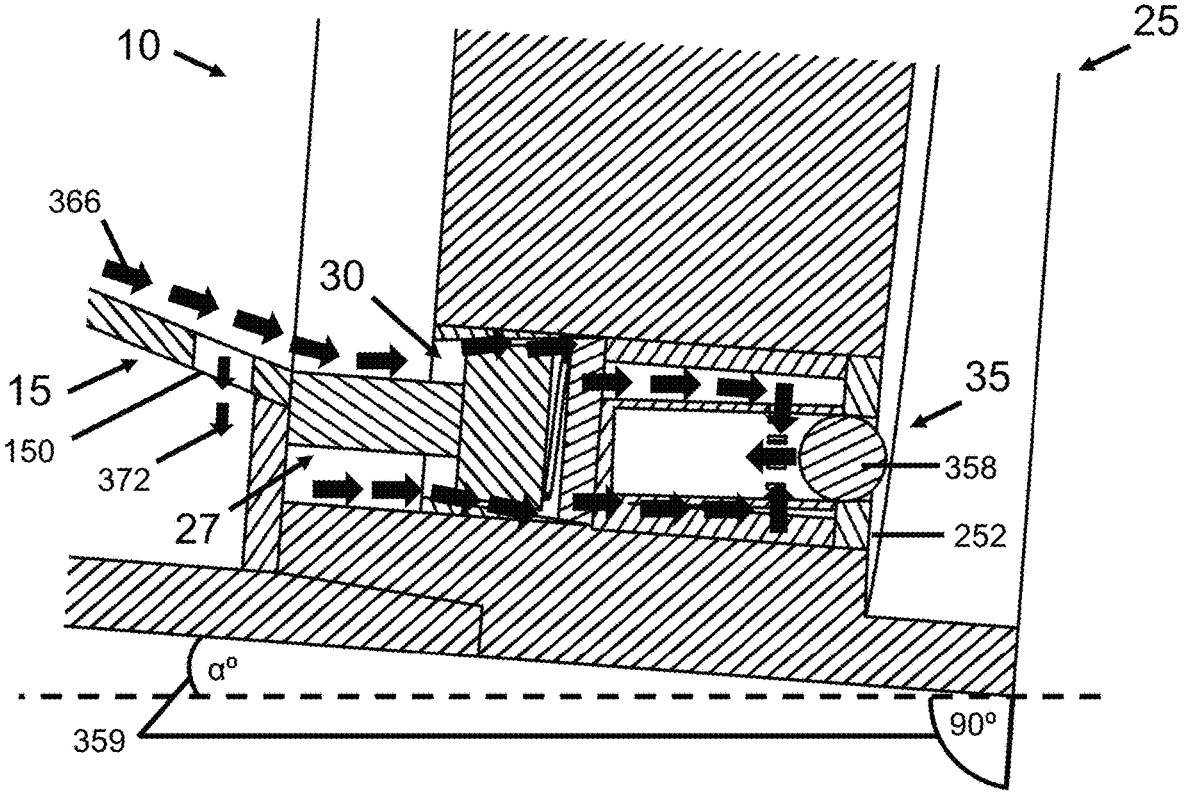
FIG. 7 shows, in simplified form, a detailed vertical cross-section of the engaged partition-lid alignment mechanism, disengaged partition engagement lock, and engaged steep tip flow throttle taken approximately along the line GG-GG in FIG. 6*b* tipped 90°+α° and blocked from dispensing fluid.

FIG. 7 shows, in simplified form, a detailed vertical cross-section of the travel mug with lid 40 tipped 90°+α° 359 having an engaged partition-lid alignment mechanism 27, a disengaged partition engagement lock 30, and an engaged steep tip flow throttle 35 taken approximately along the line GG-GG in FIG. 6*b*. Details are now given on fluid flow through these mechanisms.

At a tipping angle 90°+α° 359, the throttle engagement angle, fluid flows 366 along the partition 15. A small amount of fluid flows 372 through the aperture 150 with the majority of fluid exiting the top of the partition 15 and entering the lid 25. Fluid flow 366 continues alongside the partition-lid alignment mechanism 27, providing optimal fluid flow as the result of the lid 25 and partition 15 being aligned. Fluid flow 366 proceeds through the disengaged partition engagement lock 30 and into the engaged steep tip flow throttle 35 where it is blocked from exiting the travel mug 10. The throttle ball bearing 358 has rolled forward under gravity and blocks fluid flow 366 through the dispensing port 252.

What is claimed is:

1. A travel mug comprising:

a vessel configured to hold a fluid having an interior chamber; comprising an open upper end, configured to allow dispensing of the fluid out of the vessel, and a lower end, wherein the lower end is configured to rest on a horizontal surface; and wherein the vessel further comprises a vertical height that is perpendicular to a plane parallel to the horizontal surface;

a partition, disposable within the vessel at an angle with respect to the vertical height and configured to separate the interior chamber into at least a fluid dispensing chamber and a fluid reservoir chamber, wherein the fluid dispensing chamber has a direct fluid flow path out of the open upper end and the fluid reservoir chamber has an indirect fluid flow path out of the open upper end, through the fluid dispensing chamber;

a mechanism for blocking the indirect fluid flow path; and an air flow path configured to allow air to exit from the fluid reservoir chamber to enable fluid to flow into the fluid reservoir chamber and to allow air to enter into the reservoir chamber to enable fluid to flow out of the fluid reservoir chamber.

2. The travel mug of claim 1 where the air flow path is between the fluid reservoir chamber and the fluid dispensing chamber.

3. The travel mug of claim 1 wherein the partition is removably disposed inside the vessel.

4. The travel mug of claim 3 wherein the partition comprises friction fit sides to prevent leakage.

5. The travel mug of claim 1 wherein the partition has a bottom end that is located proximal to the lower end when the partition is disposed within the vessel and wherein the indirect fluid path is a hole through the partition located near the bottom end.

6. The travel mug of claim 5 wherein the mechanism for blocking the indirect fluid flow comprises:

a blocking object sized slightly larger than the hole and configured to fit partially in the hole in order to seal the hole; and a constraining mechanism that allows the blocking object to fall out of the hole under the force of gravity when the lower end of the vessel is in a plane parallel to the horizontal surface and constrains the object to fall into and seal the hole under the force of gravity when the lower end of the vessel is no longer in the plane substantially parallel to the plane parallel to the horizontal surface.

7. The travel mug of claim 6 is further configured to have an engagement angle.

8. The travel mug of claim 7 wherein the engagement angle is greater than 5° and less than 90°.

9. The travel mug of claim 7 wherein the engagement angle is between 10° and 25°.

10. The travel mug of claim 1 wherein the air flow path mechanism is an aperture passing through the partition located near a top of the partition.

11. The travel mug of claim 1 wherein a removably disposed lid covers the upper open end of the vessel and wherein the removably disposed lid has a dispensing port.

12. The travel mug of claim 11 further comprising a partition-lid alignment mechanism that aligns the lid dispensing port with a partition intersection.

13. The travel mug of claim 12 wherein the partition-lid alignment mechanism consists of a vertical post affixed to a top surface of the partition, sized to extend into the dispensing port.

14. The travel mug of claim 11 further comprising a partition engagement lock that blocks fluid from exiting the vessel if the partition is not disposed within the vessel.

15. The travel mug of claim 14 wherein the partition engagement lock, disposed within a beveled dispensing port, is engaged when a vertically movable beveled plug blocks fluid flow along an inwardly, downward beveled dispensing port resulting from a downward force applied to the plug.

16. The travel mug of claim 14 wherein the partition engagement lock, disposed within a beveled dispensing port, is disengaged when a vertical post affixed to a top surface of the partition, upwardly biases a vertically movable beveled plug, allowing fluid flow along a downward beveled dispensing port.

17. The travel mug of claim 11 further comprising a steep tip throttle mechanism that slows or blocks fluid from exiting the vessel if the vessel is positioned for dispensing in excess of a throttle engagement angle.

18. The travel mug of claim 17 wherein the steep tip throttle mechanism is engaged by gravity.

19. The travel mug of claim 18 wherein the steep tip throttle mechanism, disposed within a dispensing port, is disengaged when a ball bearing, sized slightly smaller than the circumference of a solid-backed inner tube with flow vents, disposed inside and affixed to an outer tube at a slight positive angle relative to the outer tube with holed cap outer circumference equal to that of outer tube circumference and hole circumference slightly smaller than the ball bearing, is at rest against the back wall of the inner tube allowing fluid to flow through the holed cap and downward beveled dispensing port when the vessel is positioned for dispensing that below the configured threshold.

20. The travel mug of claim 18 wherein the steep tip throttle mechanism, disposed within a dispensing port, is engaged when a ball bearing, sized slightly smaller than the circumference of a solid-backed inner tube with flow vents, disposed inside and affixed to an outer tube at a slight positive angle relative to the outer tube with holed cap outer circumference equal to that of outer tube circumference and hole circumference slightly smaller than the ball bearing, rolls forward and blocks the holed cap when the vessel is positioned for dispensing above the configured threshold.

* * * * *